US010417876B2

(12) United States Patent
Fujisawa et al.

(10) Patent No.: US 10,417,876 B2
(45) Date of Patent: Sep. 17, 2019

(54) GAMING MACHINE CAPABLE OF REPEATEDLY EXECUTING A UNIT GAME

(71) Applicants: Universal Entertainment Corporation, Tokyo (JP); Aruze Gaming America, Inc., Las Vegas, NV (US)

(72) Inventors: Masumi Fujisawa, Tokyo (JP); Hiroki Nakamura, Tokyo (JP); Takeshi Narita, Tokyo (JP); Hiromoto Yamauchi, Tokyo (JP)

(73) Assignees: UNIVERSAL ENTERTAINMENT CORPORATION, Tokyo (JP); ARUZE GAMING AMERICA, INC., Las Vegas, NV (US)

( * ) Notice: Subject to any disclaimer, the term of this patent is extended or adjusted under 35 U.S.C. 154(b) by 738 days.

(21) Appl. No.: 14/257,066

(22) Filed: Apr. 21, 2014

(65) Prior Publication Data

US 2014/0342801 A1 Nov. 20, 2014

(30) Foreign Application Priority Data

May 17, 2013 (JP) ..... 2013-104745

(51) Int. Cl.
*G07F 17/34* (2006.01)
*G07F 17/32* (2006.01)

(52) U.S. Cl.
CPC ..... *G07F 17/34* (2013.01); *G07F 17/3262* (2013.01)

(58) Field of Classification Search
CPC ..... G07F 17/34; G07F 17/3262
See application file for complete search history.

(56) References Cited

U.S. PATENT DOCUMENTS 6,142,875 A * 11/2000 Kodachi ..... G07F 17/3227 273/121 B
6,287,194 B1 * 9/2001 Okada ..... G07F 17/32 273/139
6,398,217 B1 * 6/2002 Shimizu ..... A63F 13/005 273/121 B
6,659,867 B1 * 12/2003 Kodachi ..... G07F 17/34 273/143 R
7,922,580 B2 4/2011 Kojima
2004/0147304 A1 * 7/2004 Shimizu ..... A63F 13/10 463/16
2008/0004103 A1 * 1/2008 Kojima ..... G07F 17/32 463/20

(Continued)

*Primary Examiner* — Corbett B Coburn
(74) *Attorney, Agent, or Firm* — Lex IP Meister, PLLC

(57) ABSTRACT

A gaming machine that is capable of providing information relevant to a winning combination to a player before spinning of a respective one of reels stops in a unit game is provided. When the player's operation is made, in the case where the predetermined symbol is displayed in the effect reel display region 410, symbol arrays of the effect reels are scrolled in an upward direction or in a downward direction and then the predetermined symbol is displayed at the to-be-stopped position, or alternatively, in the case where the predetermined symbol is not displayed, scrolling is controlled so that a symbol displayed immediately after the above situation is replaced with the predetermined symbol and then the predetermined symbol appears from an upper part of the effect reel display region 410, and stops at the to-be-stopped position.

8 Claims, 22 Drawing Sheets

(56) References Cited

U.S. PATENT DOCUMENTS

2011/0021261 A1* 1/2011 Kadode ..... G07F 17/32
463/20
2013/0296013 A1* 11/2013 Dunbar ..... G07F 17/3258
463/20

* cited by examiner

FIG. 5

SYMBOL DETERMINATION TABLE

| | FIRST VIDEO REEL | SECOND VIDEO REEL | THIRD VIDEO REEL | FOURTH VIDEO REEL | FIFTH VIDEO REEL |
|---|---|---|---|---|---|
| CODE NUMBER | SYMBOL | SYMBOL | SYMBOL | SYMBOL | SYMBOL |
| 00 | MELON | ORANGE | APPLE | CHERRY | ORANGE |
| 01 | PLUM | COIN | MELON | ORANGE | ORANGE |
| 02 | WATERMELON | APPLE | MELON | PLUM | ORANGE |
| 03 | PLUM | WILD | APPLE | WILD | COIN |
| 04 | ORANGE | CHERRY | APPLE | COIN | APPLE |
| 05 | PLUM | PLUM | WILD | PLUM | WILD |
| 06 | ORANGE | ORANGE | WATERMELON | APPLE | ORANGE |
| 07 | PLUM | CHERRY | WATERMELON | WILD | APPLE |
| 08 | WILD | APPLE | ORANGE | PLUM | WATERMELON |
| 09 | CHERRY | WATERMELON | PLUM | PLUM | MELON |
| 10 | ORANGE | CHERRY | ORANGE | WATERMELON | APPLE |
| 11 | CHERRY | WATERMELON | PLUM | MELON | APPLE |
| 12 | CHERRY | PLUM | COIN | MELON | PLUM |
| 13 | COIN | MELON | CHERRY | MELON | PLUM |
| 14 | PLUM | ORANGE | CHERRY | COIN | PLUM |
| 15 | ORANGE | COIN | COIN | APPLE | COIN |
| 16 | APPLE | MELON | CHERRY | APPLE | CHERRY |
| 17 | APPLE | MELON | ORANGE | APPLE | ORANGE |
| 18 | ORANGE | MELON | ORANGE | PLUM | COIN |
| 19 | PLUM | ORANGE | ORANGE | ORANGE | PLUM |
| 20 | COIN | APPLE | ORANGE | CHERRY | PLUM |

FIG. 7

WINNING LINE DETERMINATION TABLE

| No. | FIRST REEL | SECOND REEL | THIRD REEL | FOURTH REEL | FIFTH REEL |
|---|---|---|---|---|---|
| 1 | 1 | 1 | 1 | 1 | 1 |
| 2 | 0 | 0 | 0 | 0 | 0 |
| 3 | 2 | 2 | 2 | 2 | 2 |
| 4 | 0 | 1 | 2 | 1 | 0 |
| 5 | 2 | 1 | 0 | 1 | 2 |
| 6 | 0 | 2 | 0 | 2 | 0 |
| 7 | 2 | 0 | 2 | 0 | 2 |
| 8 | 1 | 0 | 1 | 0 | 1 |
| 9 | 1 | 2 | 1 | 2 | 1 |
| 10 | 0 | 0 | 1 | 0 | 0 |
| 11 | 2 | 2 | 1 | 2 | 2 |
| 12 | 0 | 1 | 0 | 1 | 0 |
| 13 | 1 | 2 | 0 | 2 | 1 |
| 14 | 0 | 2 | 2 | 2 | 0 |
| 15 | 2 | 0 | 0 | 0 | 2 |
| 16 | 0 | 1 | 0 | 1 | 0 |
| 17 | 2 | 1 | 2 | 1 | 2 |
| 18 | 1 | 1 | 0 | 1 | 1 |
| 19 | 1 | 1 | 2 | 1 | 1 |
| 20 | 1 | 0 | 0 | 0 | 1 |

FIG. 8

SYMBOL COMBINATION TABLE

| SYMBOL COMBINATION | | | | | NUMBER OF PAYOUTS | WINNING COMBINATION |
|---|---|---|---|---|---|---|
| FIRST VIDEO REEL | SECOND VIDEO REEL | THIRD VIDEO REEL | FOURTH VIDEO REEL | FIFTH VIDEO REEL | | |
| COIN | COIN | COIN | (ANY) | (ANY) | 25+JP | MINI JACKPOT |
| COIN | COIN | COIN | COIN | (ANY) | 100+JP | MINOR JACKPOT |
| COIN | COIN | COIN | COIN | COIN | 1000+JP | MAJOR JACKPOT |
| ORANGE | ORANGE | ORANGE | (ANY) | (ANY) | 20 | ORANGE3 |
| ORANGE | ORANGE | ORANGE | ORANGE | (ANY) | 80 | ORANGE4 |
| ORANGE | ORANGE | ORANGE | ORANGE | ORANGE | 400 | ORANGE5 |
| WATERMELON | WATERMELON | WATERMELON | (ANY) | (ANY) | 20 | WATERMELON3 |
| WATERMELON | WATERMELON | WATERMELON | WATERMELON | (ANY) | 40 | WATERMELON4 |
| WATERMELON | WATERMELON | WATERMELON | WATERMELON | WATERMELON | 200 | WATERMELON5 |
| CHERRY | CHERRY | CHERRY | (ANY) | (ANY) | 20 | CHERRY3 |
| CHERRY | CHERRY | CHERRY | CHERRY | (ANY) | 40 | CHERRY4 |
| CHERRY | CHERRY | CHERRY | CHERRY | CHERRY | 200 | CHERRY5 |
| PLUM | PLUM | PLUM | (ANY) | (ANY) | 10 | PLUM3 |
| PLUM | PLUM | PLUM | PLUM | (ANY) | 20 | PLUM4 |
| PLUM | PLUM | PLUM | PLUM | PLUM | 100 | PLUM5 |
| MELON | MELON | MELON | (ANY) | (ANY) | 10 | MELON3 |
| MELON | MELON | MELON | MELON | (ANY) | 20 | MELON4 |
| MELON | MELON | MELON | MELON | MELON | 100 | MELON5 |
| APPLE | APPLE | APPLE | (ANY) | (ANY) | 10 | APPLE3 |
| APPLE | APPLE | APPLE | APPLE | (ANY) | 20 | APPLE4 |
| APPLE | APPLE | APPLE | APPLE | APPLE | 100 | APPLE5 |
| WILD | WILD | WILD | (ANY) | (ANY) | 40 | WILD3 |
| WILD | WILD | WILD | WILD | (ANY) | 400 | WILD4 |
| WILD | WILD | WILD | WILD | WILD | 1000 | WILD5 |

GAMING MACHINE CAPABLE OF REPEATEDLY EXECUTING A UNIT GAME

CROSS-REFERENCE TO RELATED APPLICATIONS

This application is based on and claims a priority from the prior Japanese Patent Application No. 2013-104745 filed on May 17, 2013, the entire contents of which are incorporated herein by reference.

BACKGROUND OF THE INVENTION

1. Field of the Invention

The present invention relates to a gaming machine that is capable of repeatedly executing a unit game.

2. Background of the Related Art

Conventionally, it has been known that there are provided gaming machines played in such a manner that: when a player presses a spin button subsequent to entry of a gaming medium such as a coin, random numbers for determination of symbols are extracted; when a plurality of video reels displayed on a display are stopped, symbols to be displayed for the player are determined; scrolling of symbol arrays on a respective one of the video reels is started; symbols are rearranged while scrolling is stopped so that the determined symbols are displayed for the player; it is determined whether or not a combination of the displayed symbols is associated with a prize; and in the case where the combination is associated with the prize, a bonus according to a kind of the combination of the symbols is awarded to the player.

Among such gaming machines, there exists a gaming machine played in such a manner that, in order to enhance a player's sense of expectation for a special game, for example, in the case where it is determined that a predetermined number of trigger symbols or more are rearranged, an effect representative of the fact that a levelness of a probability of transfer to the special game is displayed while symbol arrays are displayed in a scrolled state, or alternatively, an effect image is displayed in such a mode as to indicate a position at which a WILD symbol that can be substituted for any normal symbol is displayed. (Reference should be made to United State Patent Application Publication No. 2011/0021261.)

In addition, there has been proposed a gaming machine played in such a manner that, in order to earlier indicate a sign of a payment to be awarded, a corresponding sign effect image is read out according to a levelness of a payment that is determined in accordance with a combination of symbols rearranged, and while symbol arrays are displayed in a scrolled state, the sign effect image is displayed. (Reference should be made to U.S. Pat. No. 7,922,580.)

However, in the gaming machines as described above, even if a sign effect is displayed, a player just sees the displayed sign effect, and the player cannot make any operation for the sign effect. The sign effect in the gaming machines mentioned above is predetermined based on rearranged symbols. Therefore, it is not permitted that the rearranged symbols that have been internally predetermined are influenced by the player's operation for the sign effect, and it is also difficult to configure the gaming machines in such a manner so as to accept an intervention exerted by such a player's operation.

Accordingly, it is an object of the present invention to provide a gaming machine in which a player can make an operation for a sign effect, thus enabling the player not to be given such an impression as if rearranged symbols were influenced.

SUMMARY OF THE INVENTION

A first embodiment of the present invention is directed to a gaming machine comprising:

a display (for example, a display made of a lower image display panel 141) having a first display region (for example, a symbol display region 4) configured to variably display first symbols including a plurality of kinds of symbols and then display the first symbols in a stopped state and a second display region (for example, an effect display region 410) configured to variably display second symbols that are associated with at least one kind of the first symbols and then display the second symbols in a stopped state;

an input device that is operated by a player; and a controller that is programmed to execute processing operations of (1-1) to (1-6) below.

The processing operation of (1-1) is directed to a processing operation of determining the first symbols to be displayed in a stopped state, by a lottery (for example, a lottery that is executed with reference to a symbol determination table by symbol lottery processing); the processing operation (1-2) is directed to a processing operation of determining whether or not the first symbols to be displayed in a stopped state form a specific combination (such as whether or not same five symbols are arranged on a winning line); the processing operation of (1-3) is directed to a processing operation of determining the second symbols that are associated with at least one kind of the first symbols to be displayed in the stopped state, in a case where it is determined that the first symbols to be displayed in the stopped state form a specific combination (for example, a processing operation of, in a case where a winning combination is a combination that is formed when five ORANGE symbols are arranged, determining the resultant winning combination as the combination formed by rearrangement of ORANGE symbols of which the number is the same as the above); the processing operation of (1-4) is directed to a processing operation of variably displaying the second symbols in the second display region before the first symbols are displayed in a stopped state in the first display region; the processing operation of (1-5) is a processing operation of displaying the second symbols in a stopped state in the second display region, based on the fact that the input device is operated (an operation of displaying the second symbols in a stopped state in the second display region); and the processing operation of (1-6) is directed to a processing operation of displaying the first symbols in a stopped state in the first display region after the second symbols have been displayed in a stopped state in the second display region.

With such a configuration of the present invention, a player makes an operation for a sign effect, that is, as a sign effect, the player causes second symbols to be displayed in a stopped state, the second symbols being associated with first symbols to be rearranged, based on the player's own operation, whereby the player can realize intervention into the sign effect as if the first symbols to be rearranged were influenced.

A second embodiment of the present invention is configured so that, in the first embodiment, the processing operation of (1-5) includes a processing operation of (1-5-1) switching a display mode when the second symbols are displayed in a stopped state in the second display region (such as displaying the second symbols to be slid and stopped in a downward direction or in an upward direction, or alternatively, forcibly changing a symbol to be displayed subsequent to a second symbol, for example), according to a display state of the second symbols in the second display region when the input device is operated (such as whether or not a second symbol is displayed in an effect reel display region 410 or whether or not a second symbol is upper or lower than a to-be-stopped position of the effect reel display region 410, for example).

With such a configuration of the present invention, before spinning of a respective one of reels stops in a unit game, information (a sign) relevant to a winning combination can be imparted to a player by second symbols, and although a respective one of the second symbols to be displayed is actually determined as a predetermined symbol, it is possible to give the player such an impression as if the second symbols were stopped by the player's operation.

A third embodiment of the present invention is configured so that, in the second embodiment, the processing operation of (1-5-1) includes a processing operation of (1-5-1-1) of displaying the second symbols in a stopped state after the second symbols each have been moved to a to-be-stopped position in a case where the second symbols are displayed in the second display region when the input device is operated.

With such a configuration of the present invention, symbol stop effect processing is conducted in such a manner that second symbols are moved and rearranged at a to-be-stopped position by a player's operation, thus disabling the player to be given an unnatural feeling relevant to stop of symbols.

A fourth embodiment of the present invention is configured so that, in the second embodiment, the processing operation of (1-5-1) includes a processing operation of (1-5-1-2), when the input device is operated, in a case where the second symbols are not displayed in the second display region, controlling symbols that appear from an upper part of the second display region immediately after the input device has been operated, so as to be obtained as the second symbols (for example, replacing an image of a symbol to be displayed, with an image of a predetermined symbol, in a video RAM), and then, moving the second symbols so as to be displayed in a stopped state at a to-be-stopped position.

With such a configuration of the present invention, a symbol stop effect is conducted in such a manner that a second symbol is moved from the outside of a display by a player's operation, and immediately after the second symbol has been moved, a predetermined symbol is rearranged at a to-be-stopped position, thus disabling the player to be given an unnatural feeling relevant to stop of symbols.

A fifth embodiment of the present invention is configured so that, in the first embodiment, the display is integrally configured with the input device that includes a touch sensor configured to detect a touch operation exerted by the player (for example, a lower image display panel 141 incorporating a touch panel 114 that is provided with a touch sensor configured to detect a touch operation exerted by a player), the display being configured so that a button for the touch operation exerted by the player is displayed in the second display region, and a size of the button is controlled to change according to a result of a lottery of the first symbols).

With such a configuration of the present invention, information relevant to first symbols, that is, sign information can be intuitively conveyed at an operational position to which a player can easily pay attention.

A sixth embodiment of the present invention is configured so that, in the first embodiment, the first display region and the second display region have an overlap portion in at least a part of these display regions, and are configured so that the second symbols are displayed so as to overlap on the first symbol.

With such a configuration of the present invention, it is possible to indicate to a player in a highlighted manner the fact that a second symbol is associated with a first symbol.

A seventh embodiment of the present invention is directed to a gaming machine comprising:

a display (for example, a display made of a lower image display panel 141) having a first display region configured to rearrange first symbols including a plurality of kinds of symbols (for example, a symbol display region 4) and a second display region configured to rearrange second symbols that are associated with at least one kind of the first symbols (for example, an effect reel display region 410);

an input device that is operated by a player; and a controller that is programmed to execute processing operations of (7-1) to (7-12) below:

(7-1) determining the first symbols to be displayed in a stopped state, by a lottery (for example, a lottery that is executed with reference to a symbol determination table, by symbol lottery processing);

(7-2) determining whether or not the first symbols to be displayed in the stopped state form a specific combination (such as a case in which five symbols of a same kind are arranged on a winning line, for example);

(7-3) in a case where it is determined that the first symbols to be displayed in the stopped state form the specific combination, determining the second symbols that are associated with at least one kind of the first symbols to be displayed in the stopped state (for example, in a case where a winning combination is a combination that is formed when five ORANGE symbols are arranged, determining the winning combination of ORANGE symbols, the number of which is the same as the above);

(7-4) before the first symbols are displayed in the stopped state in the first display region, forming the second display region so as to overlap on the first display region (such as FIG. 17B to be described later, for example);

(7-5) variably displaying the second symbols in the second display region (such as FIG. 17B to be described later, for example);

(7-6) determining a size of an operating button, based on the number of payouts corresponding to the first symbols;

(7-7) in the second display region, displaying an operating button so as to overlap on the second symbols that are variably displayed (such as FIG. 17C or FIG. 17D to be described later, for example);

(7-8) deleting the operating button from the second display region, based on a fact that the input device is operated (for example, an operation of pressing a stop button that is displayed on a touch panel) (such as FIG. 18A to be described later, for example);

(7-9) displaying the second symbols in a stopped state in the second display region, based on the fact that the input device is operated (for example, the operation of pressing the stop button that is displayed on the touch panel) (such as FIG. 18B to be described later, for example);

(7-10) displaying the first symbols in a stopped state in the first display region after the second symbols have been displayed in a stopped state in the second display region (such as FIG. 18C to be described later, for example);

(7-11) deleting the second symbols from the second display region after the first symbols have been displayed in the stopped state (such as FIG. 18C to be described later, for example); and (7-12) deleting the second display region after the second symbols have been deleted (such as FIG. 18D to be described later, for example).

Second symbols that are associated with first symbols to be rearranged are displayed in a stopped state in a second display region, based on an operation of a player, thereby enabling the player to be caused to actually realize as if the operation of the player had an influence on the first symbols to be rearranged in a first display region.

An eighth embodiment of the present invention is directed to a gaming machine, in the seventh embodiment, in which the processing operation of (7-6) includes a processing operation of (7-6-1), in a case where the number of payouts corresponding to the first symbols is equal to or greater than a predetermined number, set a size of the operating button to a first size, and in a case where the number of payouts corresponding to the first symbols is not equal to or greater than the predetermined number, set the size of the operating button to a second size that is smaller than the size of the first size.

In a case where the number of payouts is equal to or greater than a predetermined number, an operating button of a large size (a first size) is displayed, a second symbol is likely to be covered with the operating button, and there can take place a situation in which a player hardly visually recognize the second symbol. Thus, with respect to a winning combination of a large number of payouts, there takes place a situation in which well-aimed pressing by the player is difficult.

On the other hand, in a case where the number of payouts is not equal to or greater than the predetermined number, an operating button of a small size (a second size) is displayed, the second symbol is not likely to be covered with the operating button, and there does not take place a situation in which the player hardly visually recognize the second symbol. Thus, with respect to a winning combination of a small number of payouts, there takes place a situation in which the well-aimed pressing by the player is easy.

A ninth embodiment of the present invention is directed to a gaming machine, in the seventh embodiment, in which the processing operation of (7-9) includes:

a processing operation of (7-9-1), when the input device is operated, in a case where the second symbols are not displayed in the second display region, displaying the second symbols in a stopped state after the second symbols have been moved to a to-be-stopped position; and a processing operation of (7-9-2), when the input device is operated, in a case where the second symbols are not displayed in the second display region, controlling symbols that appear from a top part of the second display region immediately after the input device has been operated, so as to be the second symbols, and subsequently, moving the second symbols and then displaying the moved second symbols in a stopped state at a to-be-stopped position.

Second symbols are moved to a to-be-stopped position and are rearranged thereat, based on a timing of an operation of a player, thus, disabling the player to feel an unnatural sense relative to stop of symbols.

A tenth embodiment of the present invention is directed to a gaming machine, in the seventh embodiment, in which in the processing operations of (7-4) to (7-7), a size of the second display region is set so as to be smaller than a size of the first display region; and in the processing operation (7-8), the size of the second display region is set so as to be equal to the size of the first display region.

A first display region is hidden by a second display region, and thus, even if a first symbol is rearranged, a player cannot visually recognize the first symbol immediately, but can estimate and image what is going on until the first symbol has been recognized, thereby enabling the player to enhance an interest for the play of a game.

With a gaming machine according to the present invention, a player can make an operation for a sign effect, thus enabling the player to be given such an impression as if rearranged symbols were influenced.

BRIEF DESCRIPTION OF THE DRAWINGS

FIG. 5 is a view illustrating an array of symbols drawn on the circumferential surface of the video reels of the gaming machine.

FIG. 7 is a view illustrating a winning line determination table in a gaming machine.

FIG. 8 is a view illustrating a symbol combination table of the gaming machine.

DESCRIPTION OF PREFERRED EMBODIMENTS

[Explanation of Function Flow Diagram]

Figure 1:
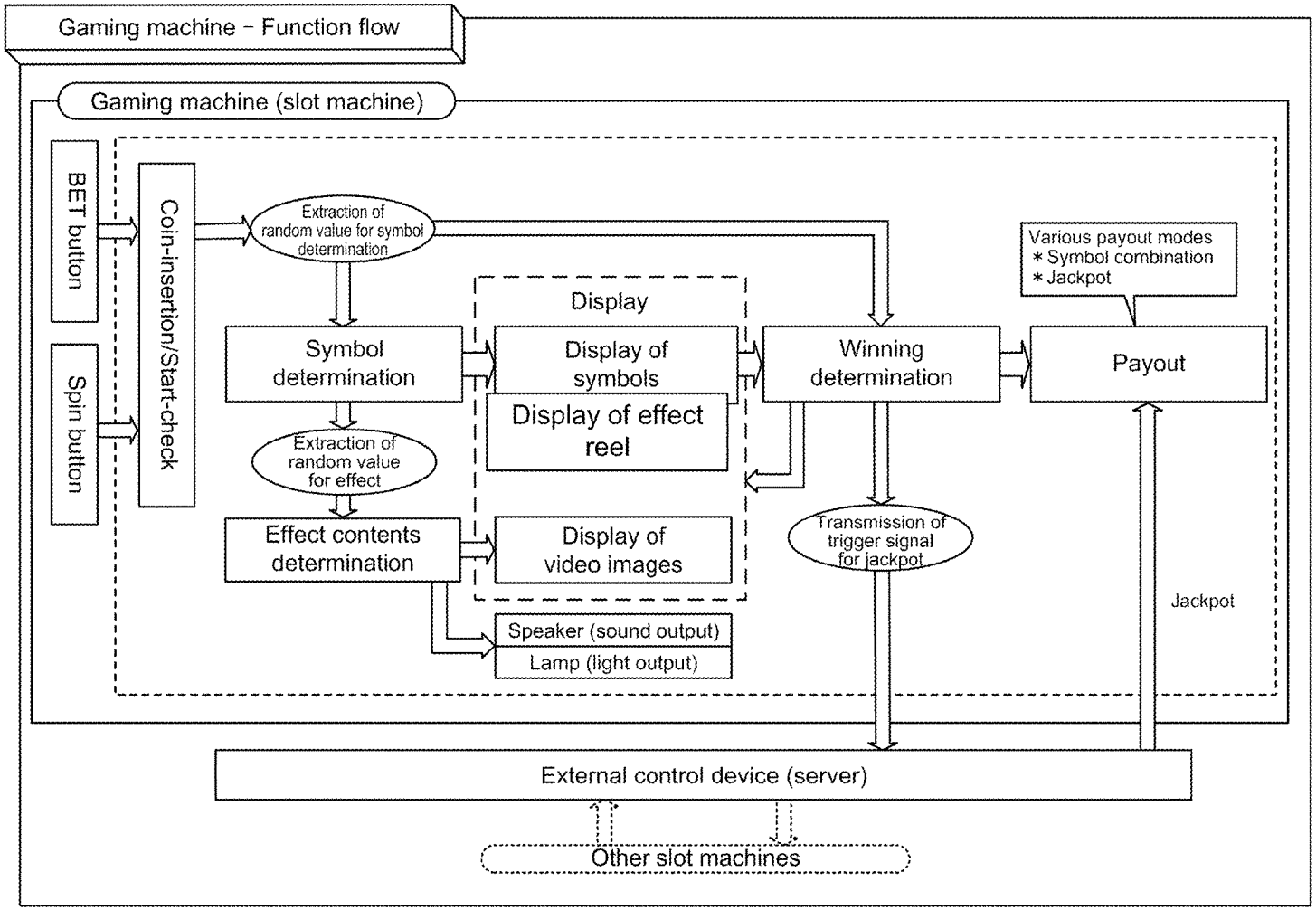
FIG. 1 is a view illustrating a function flow of the gaming machine.

With reference to FIG. 1, basic functions of the gaming machine according to the present embodiment will be described. FIG. 1 is a view illustrating a function flow of the gaming machine according to the embodiment of the present invention.

(Coin-Insertion/Start Check)

First, the gaming machine checks whether or not a BET button has been pressed by the player, and subsequently checks whether or not a spin button has been pressed by the player.

(Symbol Determination)

Next, when the spin button has been pressed by the player, the gaming machine extracts random values for symbol determination, and determines symbols to be displayed at the time of stopping scrolling of symbol arrays for the player, for a plurality of respective video reels displayed to a display.

(Symbol Display)

Next, the gaming machine starts scrolling of the symbol array of each of the video reels and then stops scrolling so that the determined symbols are displayed for the player and then rearranges the symbols.

(Winning Prize Determination)

When scrolling of the symbol array of each video reel has been stopped, the gaming machine determines whether or not a combination of symbols displayed for the player is a combination related to winning.

(Effect Reel Display)

Next, the gaming machine, in response to the result of the winning determination, displays a symbol array of effect reel different from the symbol array of the video reels according to the winning determination, and stops the scrolling in response to the player's operation, and then rearranging the symbols.

(Payout)

When the combination of symbols displayed for the player is a combination related to winning, the gaming machine offers benefits according to the combination to the player. For example, when a combination of symbols related to a payout of coins has been displayed, the gaming machine pays out coins of the number corresponding to the combination of symbols to the player.

When a combination of symbols related to a jackpot trigger is displayed, the gaming machine pays out coins in an amount of jackpot to the player. The jackpot refers to a function which accumulates parts of coins used by players at the respective gaming machines as the amount of jackpot and which, when the jackpot trigger has been established in any of the gaming machines, pays out coins of the accumulated amount of jackpot to that gaming machine. In each game, the gaming machine calculates the amount (amount for accumulation) to be accumulated to the amount of jackpot and accumulates to the amount of jackpot.

It is to be noted that, although a jackpot in the gaming machine of the present invention is basically of a network type such that a jackpot is shared by connecting gaming machines to each other in a single gaming facility or in a plurality of gaming facilities, and a cumulative amount is transmitted via an external control device (refer to FIG. 2), such a jackpot may be of a standalone type such that a single gaming machine is employed, and a part of coins that are consumed in that gaming machine is accumulated as the amount of jackpot.

In the network type, a part of coins that are consumed by a player in a respective one of the gaming machines is transmitted as the amount of jackpot to the external control device, and in the external control device, the received amount of jackpot is accumulated and then the accumulated amount is shared by the respective gaming machines. In the case where a predetermined level of jackpot is won, the amount of jackpot is transmitted from the external control device to that gaming machine.

In addition, in a game machine, a special game such as a bonus game may be provided. Hereinafter, the special game is referred to as a game in which a bonus is awarded in such a manner so that payout of coins of a predetermined amount is conducted by winning a predetermined combination, or alternatively, a winning probability is advantageously set.

(Determination Contents of Effects)

The gaming machine produces effects by displaying images to the display, outputting the light from lamps, and outputting sounds from speakers. The gaming machine extracts a random value for effect and determines contents of the effects based on the symbols and the like determined by lottery.

[Overall Game System]

Figure 2:
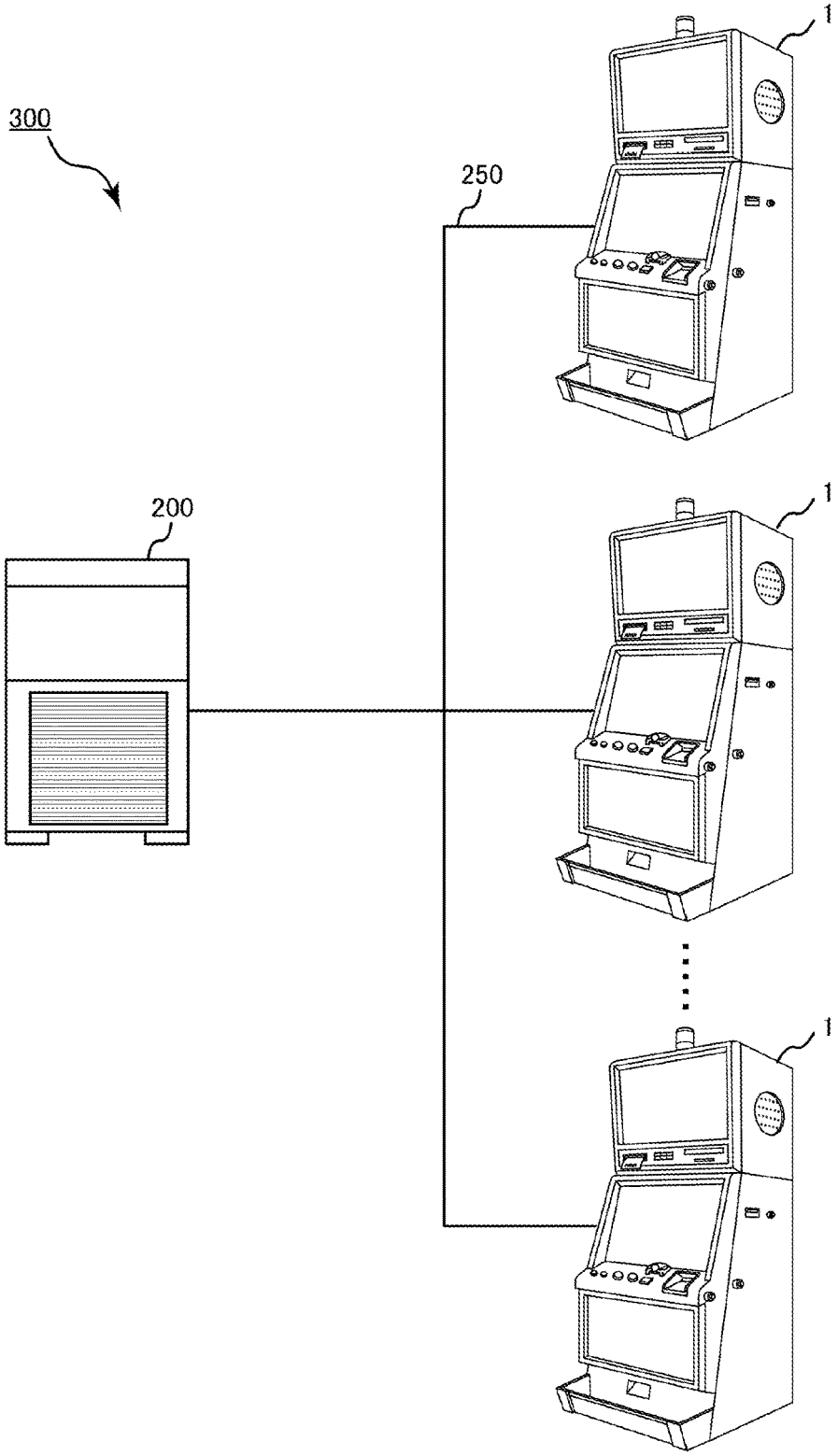
FIG. 2 is a view illustrating a game system including the gaming machine.

The basic functions of the gaming machine have been described above. Next, with reference to FIG. 2, a game system including the gaming machine is described. FIG. 2 is a view illustrating the game system including the gaming machine according to the embodiment of the present invention.

A game system 300 includes the plurality of gaming machines 1, and an external control device 200 that is connected to each of the gaming machines 1 through a communication line 250.

The external control device 200 is for controlling the plurality of gaming machines 1. In the present embodiment, the external control device 200 is a so-called hall server which is installed in a game facility having the plurality of gaming machines 1. Each of the gaming machines 1 is provided with a unique identification number, and the external control device 200 identifies transmission sources of data transmitted from the respective gaming machines 1 by using the identification numbers. Also in the case where the external control device 200 transmits data to a gaming machine 1, the identification numbers are used for specifying the transmission destination.

It is to be noted that the game system 300 may be constructed within a single game facility where various games can be conducted, such as a casino, or may be constructed among a plurality of game facilities. Further, when the game system 300 is constructed in a single game facility, the game system 300 may be constructed in each floor or section of the game facility. The communication line 250 may be a wired or wireless line, and can adopt a dedicated line, an exchange line or the like.

[Overall Configuration of Gaming Machine]

Figure 3:
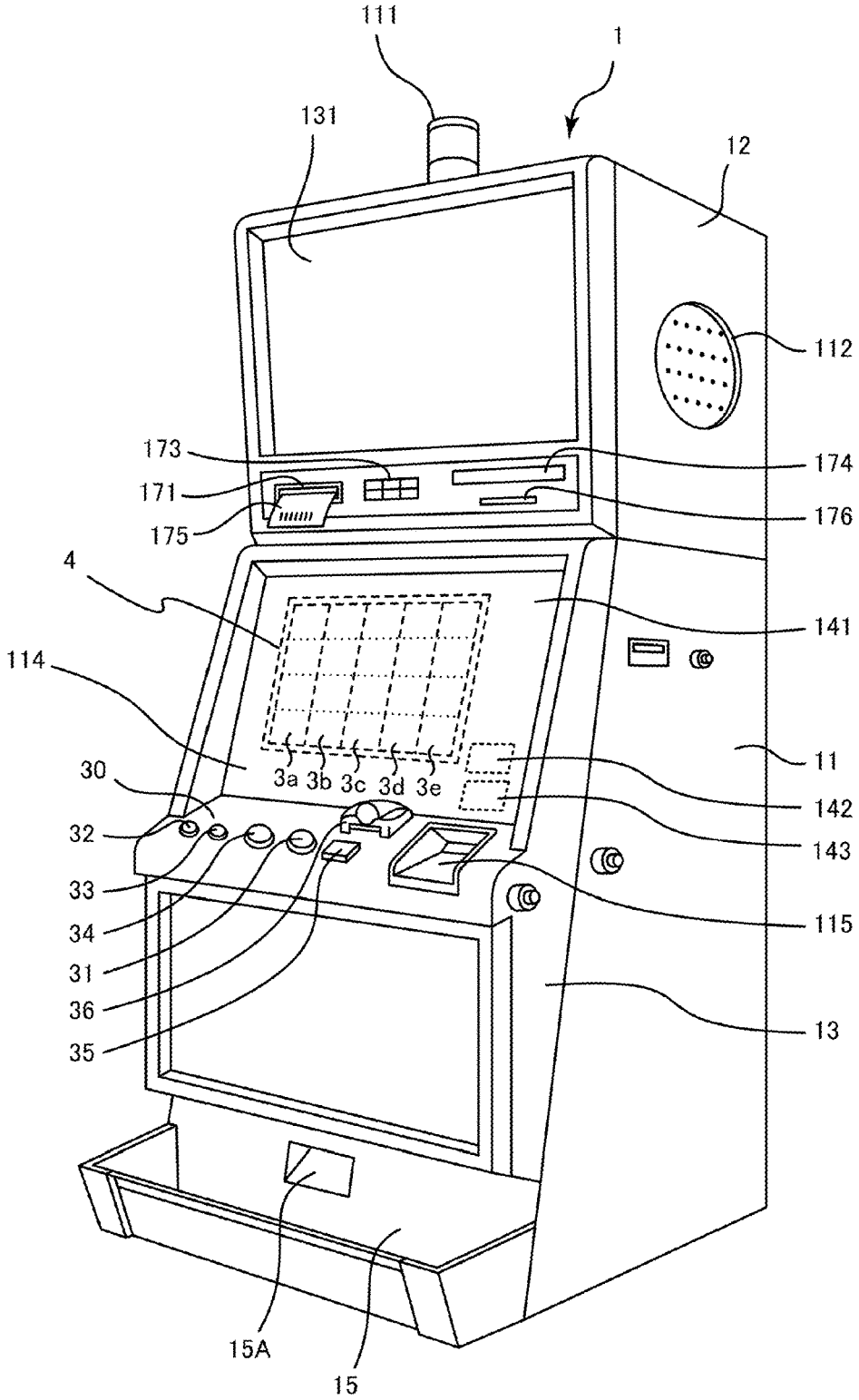
FIG. 3 is a view illustrating an overall configuration of the gaming machine.

The game system according to the present embodiment has been described above. Next, with reference to FIG. 3, an overall configuration of the gaming machine 1 is described. FIG. 3 is a view illustrating the overall configuration of the gaming machine according to the embodiment of the present invention.

A coin, a bill, or electrically valuable information corresponding to these is used as a game medium in the gaming machine 1. Further, in the present embodiment, a later-described ticket with a barcode is also used. It is to be noted that the game medium is not limited to these, and for example a medal, a token, electric money or the like can be adopted.

The gaming machine 1 includes a cabinet 11, a top box 12 installed on the upper side of the cabinet 11, and a main door 13 provided at the front face of the cabinet 11.

A lower image display panel 141 is provided at the center of the main door 13. The lower image display panel 141 includes a liquid crystal panel, and forms the display. The lower image display panel 141 has a symbol display region 4. To the symbol display region 4, five video reels 3 (3*a*, 3*b*, 3*c*, 3*d*, 3*e*) are displayed. In the present embodiment, a video reel depicts through videos the rotational and stop motions of a mechanical reel having a plurality of symbols drawn on the peripheral surface thereof. To each of the video reels 3, a symbol array comprised of a previously determined plurality (21 in the present embodiment) of symbols is assigned (see FIG. 5 which is described later).

The symbol display region 4, the symbol arrays assigned to the respective video reels 3 are separately scrolled, and are stopped after predetermined time has elapsed. As a result, a part (three consecutive symbols in the present embodiment) of each of the symbol arrays is displayed for the player. The symbol display region 4 has three regions, an upper region, a central region, and a lower region, for each video reel 3, and a single symbol is to be displayed to each region. That is, 15 (=5 columns×3 symbols) symbols are to be displayed in the symbol display region 4.

In the present embodiment, a line formed by selecting one of the aforementioned three regions for each of the video reels 3 and connecting the respective regions is referred to as a winning line (hereinafter also referred to as a "pay line"). It is to be noted that any desired shape of the winning line can be adopted, and examples of the shape of the winning line may include a straight line formed by connecting the upper central regions for the respective video reels 3, a V-shaped line, and a bent line. Also, any desired number of lines can be adopted, and the number can be for example 20 lines. For more information on the pay lines will be described later with reference to FIG. 7.

Further, in the present embodiment, the lower image display panel 141, the effect reel made up of symbol array of one or more different from the symbol arrays is displayed.

In addition, the lower image display panel 141 has a number of credit display area 142 and a number of payout display area 143. The number of credit display area 142, with a coin that is owned by the player, the number of coins that are deposited inside the gaming machine 1 (hereinafter, the number of credits) is displayed. Further, the number of payout display area 143, the number of coins to be paid out to the player when the winning is established (hereinafter, the number of payouts) is displayed.

The lower image display panel 141 includes a built-in touch panel 114 having a touch sensor for detecting a touch operation of the player. The player can input various commands by touching the lower image display panel 141. If the effect reels are displayed, the stop button is displayed, and by pressing the stop button, the player can stop the scrolling of the symbol arrays of the effect reels.

Figure 4:
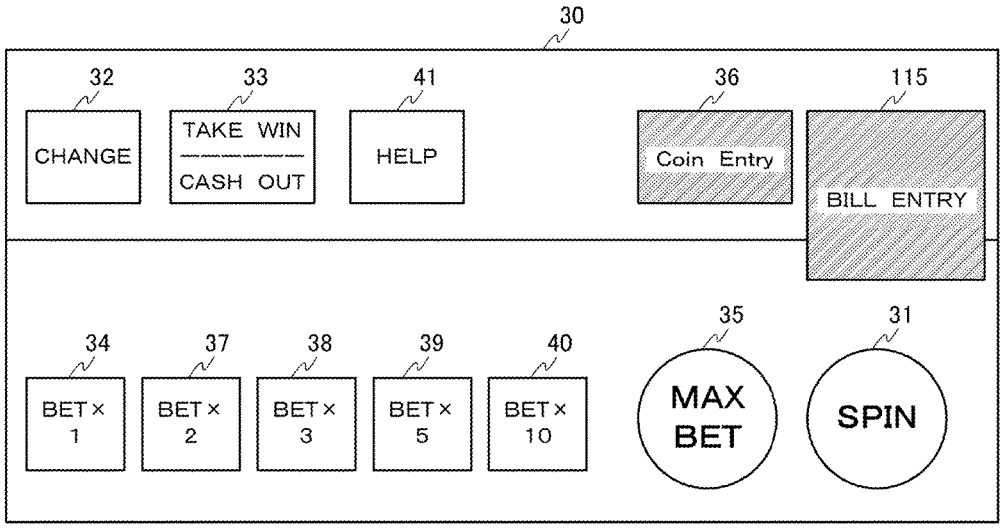
FIG. 4 is a view illustrating an arrangement of a control panel of the gaming machine.

On the lower side of the lower image display panel 141, there are arranged various buttons set in a control panel 30, and various devices to be operated by the player, and its details are shown in FIG. 4.

A spin button 31 is used when starting scrolling of the symbol arrays of the respective video reels 3. A change button 32 is used when requesting a game facility staff member to exchange money. A CASHOUT button 33 is used when paying out the coins retained inside the gaming machine 1 to a coin tray 15.

A 1-BET button (BET×1) 34 and a maximum BET button (MAX BET) 35 are used for determining the number of coins (hereinafter also referred to as "the number of BETs") to be used in the game from the coins retained inside the gaming machine 1. The 1-BET button 34 is used when determining one coin at a time for the aforementioned number of BETs. The maximum BET button 35 is used when setting the aforementioned number of BETs to a defined upper limit number. The other, 2-BET button (BET×2) 37, 3-BET button (BET×3) 38, 5-BET button (BET×5) 39, 10-BET button (BET×10) 40 are arranged as shown in FIG. 4.

A coin accepting slot 36 (Coin Entry) is provided to accept coins. A bill validator (BILL ENTRY) 115 is provided to accept bills. The bill validator 115 validates a bill, and accepts a valid bill into the cabinet 11. It is to be noted that the bill validator 115 may be configured so as to be capable of reading a later-described ticket 175 with a barcode.

An upper image display panel 131 is provided at the front face of the top box 12. The upper image display panel 131 includes a liquid crystal panel, and forms the display. The upper image display panel 131 displays images related to effects and images showing introduction of the game contents and explanation of the game rules. Further, the top box 12 is provided with a speaker 112 and a lamp 111. The gaming machine 1 produces effects by displaying images, outputting sounds, and outputting the light.

A ticket printer 171, a card slot 176, a data display 174, and a keypad 173 are provided on the lower side of the upper image display panel 131.

The ticket printer 171 prints on a ticket a barcode representing encoded data of the number of credits, date, the identification number of the gaming machine 1, and the like, and outputs the ticket as the ticket 175 with a barcode. The player can make a gaming machine read the ticket 175 with a barcode so as to play a game thereon, and can also exchange the ticket 175 with a barcode with a bill or the like at a predetermined place (e.g. a cashier in a casino) in the game facility.

The card slot 176 is for inserting a card in which predetermined data is stored. For example, the card stores data for identifying the player, and data about the history of games played by the player. When the card is inserted into the card slot 176, a later-described card reader 172 reads data from the card or writes data into the card. It is to be noted that the card may store data corresponding to a coin, a bill or a credit.

The data display 174 includes a fluorescent display, LEDs and the like, and displays the data read by the card reader 172 or the data inputted by the player via the keypad 173, for example. The keypad 173 is for inputting a command and data related to ticket issuance or the like.

Although a gaming machine according to the embodiment of the present invention is configured to control displaying of video reels on a display, the gaming machine may be a gaming machine of such a type as to display symbols for a player by driving mechanical reels by a stepping motor or the like. It is to be noted that, in that case, in order to separately display an effect reel, a lower image display panel 141 can be made of a transparent display, for example, so as to display a motion image that is representative of the effect reel.

[Symbol Arrays of Video Reels]

The overall configuration of the gaming machine 1 has been described above. Next, with reference to FIG. 5, a configuration of the symbol arrays included in the video reels 3 of the gaming machine 1 is described. FIG. 5 is a showing an array of symbols drawn on the peripheral surface of the reel of the gaming machine according to an embodiment of the present invention.

A first video reel 3*a*, a second video reel 3*b*, a third video reel 3*c*, a fourth video reel 3*e*, and a fifth video reel 3*d* each is assigned with a symbol array consisting of 21 symbols that correspond to respective code numbers from "00" to "20".

Types of the symbols provided are "ORANGE", "MELON", "PLUM", "WATERMELON", "CHERRY", and "APPLE". In addition, "WILD" serves as a wild symbol, "COIN" according to the jackpot winning combination is also provided.

[Configuration of Circuit Included in Gaming Machine]

Figure 6:
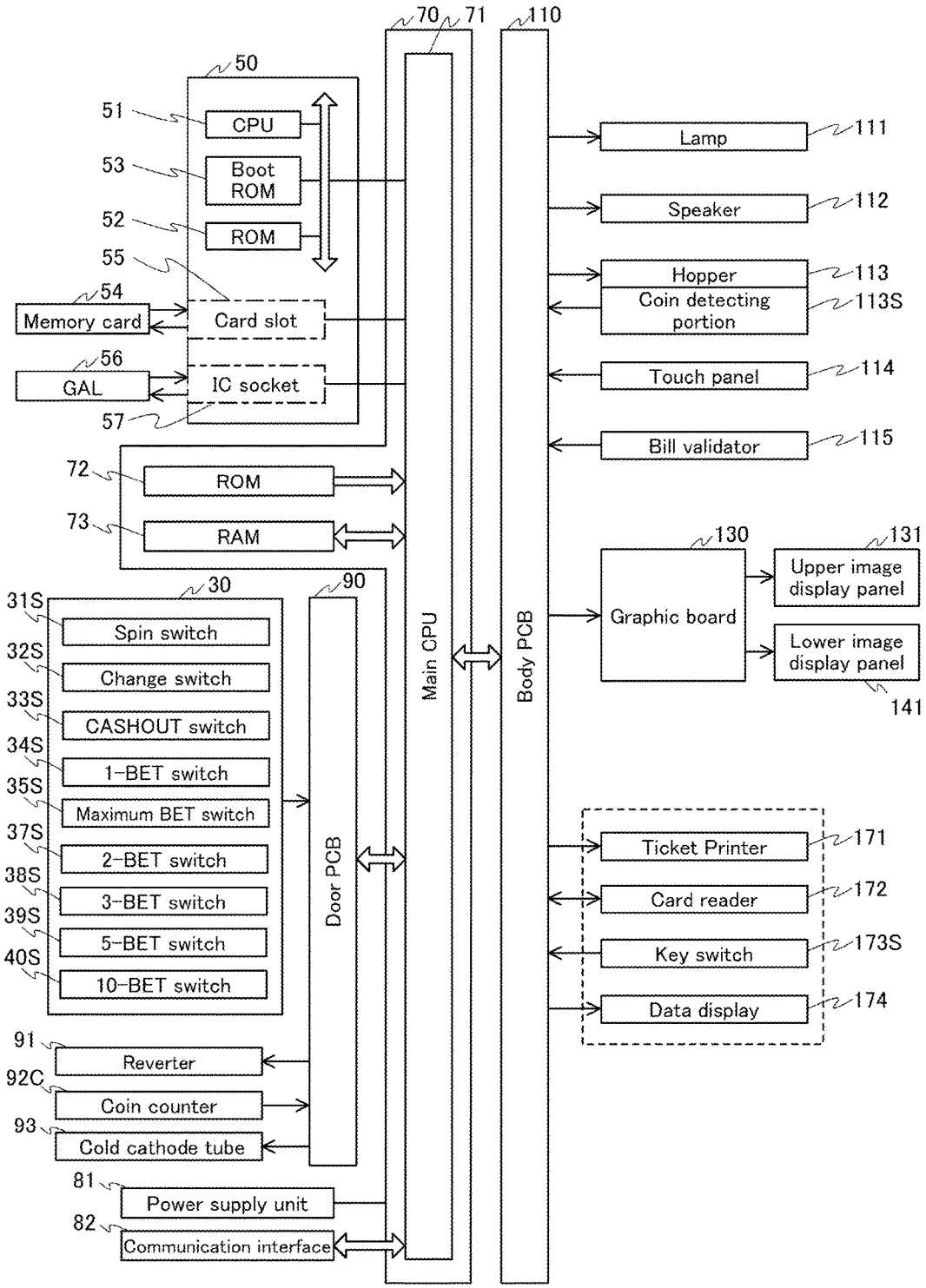
FIG. 6 is a block diagram illustrating an internal configuration of the gaming machine.

The configuration of the symbol arrays included in the video reels 3 of the gaming machine 1 has been described above. Next, with reference to FIG. 6, a configuration of a circuit included in the gaming machine 1 is described. FIG. 6 is a block diagram illustrating an internal configuration of the gaming machine according to the embodiment of the present invention.

A gaming board 50 is provided with: a CPU 51, a ROM 52, and a boot ROM 53, which are mutually connected by an internal bus; a card slot 55 corresponding to a memory card 54; and an IC socket 57 corresponding to a GAL (Generic Array Logic) 56.

The memory card 54 includes a non-volatile memory, and stores a game program and a game system program. The game program includes a program related to game progression, a lottery program, and a program for producing effects by images and sounds (e.g. see FIGS. 10 to 16 which are described later). Further, the aforementioned game program includes data (see FIG. 5) specifying the configuration of the symbol array assigned to each video reel 3.

The lottery program is a program for determining to-be-stopped symbol of each video reel 3 by lottery. The to-be-stopped symbol is data for determining three symbols to be displayed to the symbol display region 4 out of the 21 symbols forming each symbol array. The gaming machine 1 of the present embodiment determines as the to-be-stopped symbol the symbol to be displayed in a predetermined region (the upper region) out of the three regions provided for each of the video reels 3 of the symbol display region 4.

The aforementioned lottery program includes symbol determination data. The symbol determination data is data that specifies random values so that each of the 21 symbols (code numbers from "00" to "20") forming the symbol array is determined at an equal probability (i.e. 1/21), for each video reel 3. The probabilities of the respective 21 symbols being determined are basically equal. However, the numbers of the respective types of symbols included in the 21 symbols vary, and thus the probabilities of the respective types of symbols being determined vary (i.e. different weights on the probabilities are generated). For example, with reference to FIG. 5, the symbol array of the first video reel 3*a* includes one symbol of "MELON", and includes five symbols of "ORANGE". Hence, the former is determined at the probability of "1/21", whereas the latter is determined at the probability of "5/21". Furthermore, the symbols may also be determined by the weight and the random number value by setting a weight to symbols of each reel.

It is to be noted that, although the data specifies that the equal numbers of symbols be provided to form the symbol arrays of the respective video reels 3 in the present embodiment, different numbers of symbols may form the respective video reels 3. For example, the symbol array of the first video reel 3*a* may consist of 21 symbols whereas the symbol array of the second video reel 3*b* may consist of 30 symbols. Such a configuration increases the degree of freedom in setting the probabilities of the respective types of symbols being determined for each video reel 3.

Further, the card slot 55 is configured so that the memory card 54 can be inserted thereinto and removed therefrom, and is connected to a motherboard 70 by an IDE bus.

The GAL 56 is a type of PLD (Programmable Logic Device) having a fixed OR array structure. The GAL 56 is provided with a plurality of input ports and output ports, and predetermined input into the input port causes output of the corresponding data from the output port.

Further, the IC socket 57 is configured so that the GAL 56 can be inserted thereinto and removed therefrom, and is connected to the motherboard 70 by a PCI bus. The contents of the game to be played on the gaming machine 1 can be changed by replacing the memory card 54 with another memory card 54 having another program written therein or by rewriting the program written into the memory card 54 as another program.

The CPU 51, the ROM 52 and the boot ROM 53 mutually connected by the internal bus are connected to the motherboard 70 by a PCI bus. The PCI bus enables a signal transmission between the motherboard 70 and the gaming board 50, and power supply from the motherboard 70 to the gaming board 50.

The ROM 52 stores an authentication program. The boot ROM 53 stores a pre-authentication program, a program (boot code) to be used by the CPU 51 for activating the pre-authentication program, and the like. The authentication program is a program (tamper check program) for authenticating the game program and the game system program. The pre-authentication program is a program for authenticating the aforementioned authentication program. The authentication program and the pre-authentication program are written along a procedure (authentication procedure) for proving that the program to be the subject has not been tampered.

The motherboard 70 includes a main CPU 71, a ROM 72, a RAM 73, and a communication interface 82.

The ROM 72 includes a memory device such as a flash memory, and stores a program such as BIOS to be executed by the main CPU 71, and permanent data. When the BIOS is executed by the main CPU 71, processing for initializing predetermined peripheral devices is conducted; further, through the gaming board 50, processing of loading the game program and the game system program stored in the memory card 54 is started.

The RAM 73 stores data and programs which are used in operation of the main CPU 71. For example, when the processing of loading the aforementioned game program, game system program or authentication program is conducted, the RAM 73 can store the program. The RAM 73 is provided with working areas used for operations in execution of these programs. Examples of the areas include: an area that stores a counter for managing the number of games, the number of BETs, the number of payouts, the number of credits and the like; and an area that stores symbols (code numbers) determined by lottery.

The communication interface 82 is for communicating with the external control device 200 such as a server, through the communication line 250. Further, the motherboard 70 is connected with a later-described door PCB (Printed Circuit Board) 90 and a body PCB 110 by respective USBs. The motherboard 70 is also connected with a power supply unit 81. When the power is supplied from the power supply unit 81 to the motherboard 70, the main CPU 71 of the motherboard 70 is activated, and then the power is supplied to the gaming board 50 through the PCI bus so as to activate the CPU 51.

The door PCB 90 and the body PCB 110 are connected with input devices such as a switch and a sensor, and peripheral devices the operations of which are controlled by the main CPU 71. The door PCB 70 is connected with a control panel 30, a reverter 91, a coin counter 92C and a cold cathode tube 93.

The control panel 30 is provided with a spin switch 31S, a change switch 32S, a CASHOUT switch 33S, a maximum BET switch 35S, a 2-BET switch 37S, a 3-BET switch 38S, a 5-BET switch 39S and a 10-BET switch 40S which correspond to the aforementioned respective buttons. Each of the switches outputs a signal to the main CPU 71 upon detection of press of the button corresponding thereto by the player.

The coin counter 92C validates a coin inserted into the coin accepting slot 36 based on its material, shape and the like, and outputs a signal to the main CPU 71 upon detection of a valid coin. Invalid coins are discharged from a coin payout exit 15A.

The reverter 91 operates based on a control signal outputted from the main CPU 71, and distributes valid coins validated by the coin counter 92C into a hopper 113 or a cash box (not illustrated). That is, coins are distributed into the hopper 113 when the hopper 113 is not filled with coins, while coins are distributed into the cash box when the hopper 113 is filled with coins.

The cold cathode tube 93 functions as a backlight installed on the rear face sides of the upper image display panel 131 and the lower image display panel 141, and lights up based on a control signal outputted from the main CPU 71.

The body PCB 110 is connected with the lamp 111, the speaker 112, the hopper 113, a coin detecting portion 113S, the touch panel 114, the bill validator 115, a graphic board 130, the ticket printer 171, the card reader 172, a key switch 173S and the data display 174.

The lamp 111 lights up based on a control signal outputted from the main CPU 71. The speaker 112 outputs sounds such as BGM, based on a control signal outputted from the main CPU 71.

The hopper 113 operates based on a control signal outputted from the main CPU 71, and pays out coins of the specified number of payouts from the coin payout exit 15A to the coin tray 15. The coin detecting portion 113S outputs a signal to the main CPU 71 upon detection of coins paid out by the hopper 113.

The touch panel 114 detects a place on the lower image display panel touched by the player's finger or the like, and outputs to the main CPU 71 a signal corresponding to the detected place. Similarly, the touch panel 114 can also be configured as a touch panel the upper image display panel 131. Upon acceptance of a valid bill, the bill validator 115 outputs to the main CPU 71 a signal corresponding to the face amount of the bill.

The graphic board 130 controls display of images conducted by the respective upper image display panel 131 and lower image display panel 141, based on a control signal outputted from the main CPU 71. The symbol display region 4 of the lower image display panel 141 displays the five video reels 3 by which the scrolling and stop motions of the symbol arrays included in the respective video reels 3 are displayed. Similarly, in the effect reel display area 410 of the lower image display panel 141, the effect reel is displayed, by which the scrolling and stop motions of the symbol arrays provided in the effect reel are displayed. The graphic board 130 is provided with a VDP generating image data, a video RAM temporarily storing the image data generated by the VDP, and the like. The credit amount display region 142 of the lower image display panel 141, the number of credits stored in the RAM 73 is displayed. The payout amount display area 143 of the lower image display panel 141, the number of coins payout is displayed.

The graphic board 130 is provided with the VDP (Video Display Processor) generating image data based on a control signal outputted from the main CPU 71, the video RAM temporarily storing the image data generated by the VDP, and the like. It is to be noted that the image data used in generation of image data by the VDP is included in the game program that has been read from the memory card 54 and stored into the RAM 73.

Based on a control signal outputted from the main CPU 71, the ticket printer 171 prints on a ticket a barcode representing encoded data of the number of credits stored in the RAM 73, date, the identification number of the gaming machine 1, and the like, and then outputs the ticket as the ticket 175 with a barcode.

The card reader 172 reads data stored in a card inserted into the card slot 176 and transmits the data to the main CPU 71, or writes data into the card based on a control signal outputted from the main CPU 71.

The key switch 173S is provided in the keypad 173, and outputs a predetermined signal to the main CPU 71 when the keypad 173 has been operated by the player.

The data display 174 displays data read by the card reader 172 and data inputted by the player through the keypad 173, based on a control signal outputted from the main CPU 71.

[Configuration of Winning Line Determination Table]

Next, with reference to FIG. 7, a configuration of a winning line determination table will be described. In a gaming machine 1, twenty winning lines are set relative to a symbol matrix that is displayed in a symbol display region 4. The winning line determination table shows that any one of a first line to a third line forms a winning line with respect to a respective one of first to fifth video reels 3*a* to 3*e*.

For example, an indication of No.=1 of FIG. 7 expresses the fact that one winning line is formed by a second line of a first video reel 3*a* (a first column), a second line of a second video reel 3*b* (a second column), a second line of a third video reel 3*c* (a third column), a second line of a fourth video reel 3*d* (a fourth column), and a second line of a fifth video reel 3*e* (a fifth column).

A respective one of the winning lines can be made active according to a player's selection. However, all of the twenty winning lines can be set so as to be active regardless of whatsoever the amount of bets or the player's selection may be. A total number of winning lines can be changed according to a size of a symbol matrix, and another winning line can also be appropriately set.

[Configuration of the Symbol Combination Table]

Next, referring to FIG. 8, a symbol combination table is described. FIG. 8 shows a symbol combination table of the gaming machine 1 according to the embodiment of the present invention.

The symbol combination table defines the combination of symbol patterns of symbols related to winning and the number of payouts. In the gaming machine 1, when scroll of the symbol column of each video reel 3 is stopped, and the combination of symbols to be displayed on winning lines matches the combination of symbols that are defined by the symbol combination table, winning is established. Then, according to the winning combination, a benefits as payout of coins is given to the player. In the case where the combination of symbols displayed on the winning line does not match any of the combinations of symbols defined by the symbol combination table, no winning combination (a so-called "losing") is established.

The symbol combination table defines what amount of payouts are to be conducted in the case where which one of symbol combinations is displayed on the first to fifth video reels 3*a* to 3*e* in a winning line that is defined in the winning line table.

In the case where a part of the displayed symbol combination may be an arbitrary symbol, such a symbol is defined as an (ANY) symbol. Although (ANY) symbols are conveniently set on the fourth reel and the fifth reel, the present embodiment represents that, in the case where the (ANY) symbols are respectively set on the fourth reel and the fifth reel, the fact denotes that any two of the firth to fifth video reels 3*a* to 3*e* include arbitrary symbols, or alternatively, in the case where an (ANY) symbol is displayed only on the fifth reel, the fact denotes that any one of the first to fifth reels includes an arbitrary symbol.

Therefore, among "COIN", "ORANGE", "WATERMELON", "CHERRY", "PLUM", "MELON", "APPLE", and "WILD" symbols, if three or more symbols of one kind are rearranged, a winning combination is established. The number of payouts is different depending on the symbols, and with respect to the symbols of a same kind, the number of payouts is set so as to be greater in a sequential order of combinations of three, four, and five symbols of a same kind.

In addition, in the case where three COIN symbols are rearranged on a winning line, a winning combination is established as a "MINI JACKPOT", and the number of payouts is computed as the number that is obtained by adding the amount of jackpot (mini) to 25. In the case where four COIN symbols are rearranged on a winning line, a winning combination is established as a "MINOR JACKPOT", the number of payouts is computed as the number that is obtained by adding the amount of jackpot (minor) to 100. Similarly, in the case where five COIN symbols are rearranged on a winning line, a winning combination is computed as a "MAJOR JACKPOT", the winning combination is computed as the number that is obtained by adding the amount of jackpot (major) to 1,000. In addition, whether or not to add the amount of jackpot to the number of payouts can be determined by a lottery and further its related lottery probability can be changed according to the number of bets.

It is to be noted that in the case where a WILD symbol is displayed, the displayed symbol is evaluated as a substitute object other than a COIN symbol (a so called wildcard). For example, in the case where four ORANGE symbols and one WILD symbol are displayed in a winning line across the first to fifth video reels 3*a* to 3*e*, it is determined that a winning combination "ORANGE 5" of the number of payouts=400 is won.

It is to be noted that, although FIG. 8 shows only one symbol combination table, such only one table can be controlled so as to be switched to another symbol combination table in accordance with a variety of conditions.

[Functions of Game Program]

Figure 9:
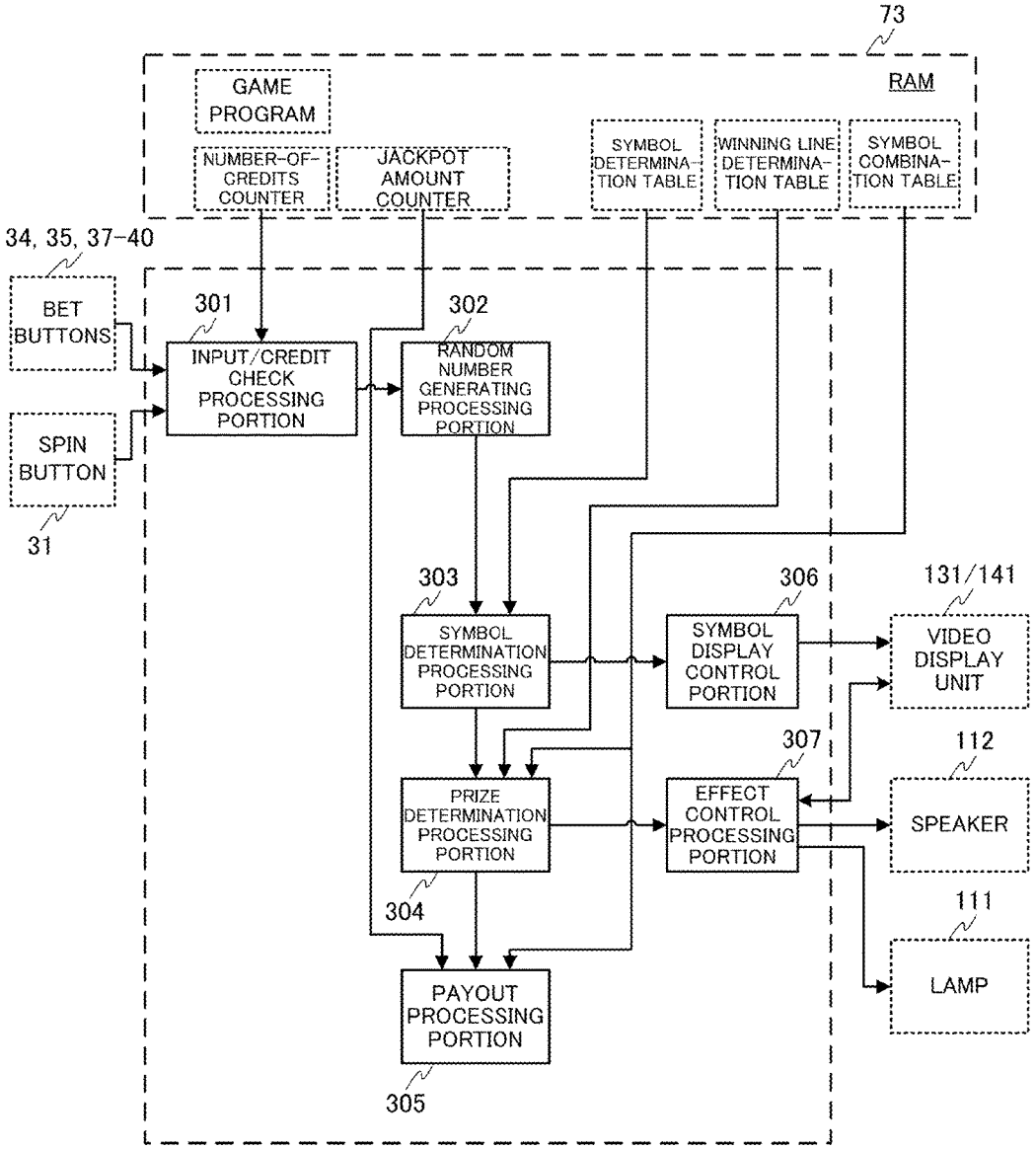
FIG. 9 is a view illustrating a functional block diagram of the gaming machine.

FIG. 9 is a functional block diagram illustrating functions of a game program that is executed by a main CPU 71 of a motherboard 70. When power is supplied to a gaming machine 1, the main CPU 71 reads a game program and a game system program which have been authenticated, from a memory card 54 via a gaming board 50, and writes these two programs in a RAM 73. The authenticated game program is thus executed in a state in which the game program is loaded in the RAM 73.

According to the preferred embodiment, the authenticated game program include: an input/credit check processing portion 301; a random number generating processing portion 302; a symbol determination processing portion 303; a prize determination processing portion 304; a payout processing portion 305; a symbol display control portion 306; and an effect control processing portion 307.

The input/credit check processing portion 301 contiguously checks whether any one of BET buttons 34, 35, and 37 to 40 or a spin button 31 is pressed in an idle state in which the first to fifth video reels 3*a* to 3*e* stop. In the case where any one of the BET buttons or the spin button is pressed, the input/credit check processing portion 301 checks whether or not a player's credit still remains based on a number-of-credits counter that is stored in the RAM 73. In the case where at least one credit of the player still remains, the input/credit check processing portion 301 invokes the random number generating processing portion 302.

Then, the random number generating processing portion 302 generates random numbers, and the generated random numbers are available for use in the symbol determination processing portion 303. In the embodiment, the random number generating processing portion 302 generates five random numbers. These five random numbers are respectively employed in order to determine symbols on the first to fifth video reels 3*a* to 3*e*.

After all of the five random numbers have been extracted, the symbol determination processing portion 303 determines to-be-stopped symbols in a respective one of the first to fifth video reels 3*a* to 3*e* with reference to the symbol determination table that is stored in the RAM 73. The symbol determination processing 303 determines five to-be-stopped symbols in a plurality of scroll lines (for example, five video reels 3*a* to 3*e*) by employing the five random numbers, and in a symbol display region 4, symbols that are associated with a respective one of a plurality of scroll lines (for example, five video reels 3*a* to 3*e*) are caused to appear.

The symbol display control portion 306 controls a video display unit (a lower image display panel 141) in order to the symbols that are determined by the symbol determination processing portion 303. The video reels 3*a* to 3*e* after spun are displayed so as to stop at appropriate positions that are specified according to stop position information. That is, all the symbols scroll with spinning of the video reels 3*a* to 3*e*. Next, the video reels 3*a* to 3*e* are stopped so that the determined symbols are rearranged at appropriate positions of an upper stage in a vertical direction in the symbol display region 4.

The prize determination processing portion 304 determines whether or not a predetermined winning combination is established by the rearranged symbols, with reference to the winning line determination table and the symbol combination table that are stored in the RAM 73. In the case where the winning combination is established by the rearranged symbols, the effect control processing portion 307 is instructed so as to conduct an effect according to the established winning combination.

The effect control processing portion 307 conducts the effect according to the established winning combination with a timing of symbol scrolling or stop or the like, in accordance with an instruction from the prize determination processing portion 304. Among these effects, there exists: an effect exerted by video display and audio sound employing the upper image display panel 131, the lower image display panel 141, and the speaker 112; and an effect configured to conduct lighting or blinking of the lamp 111, for example.

In addition, in the case where a winning combination is established as a predetermined combination, the effect control processing portion 307 displays an effect reel in the symbol display region 4, and if a player's touch operation is detected from the lower image display panel 141 that is configured as a touch panel, a further effect is executed according to that operation. A detailed description of these effects will be given later.

The payout processing portion 305 determines the number of payouts according to the established winning combination with reference to the jackpot amount counter and the symbol combination table that are stored in the RAM 73, and awards a payment or credits or the like according to the number of payouts to a player.

[Contents of Program]

Next, with reference to FIGS. 10 to 22, the program to be executed by the gaming machine 1 is described.

<Main Control Processing>

Figure 10:
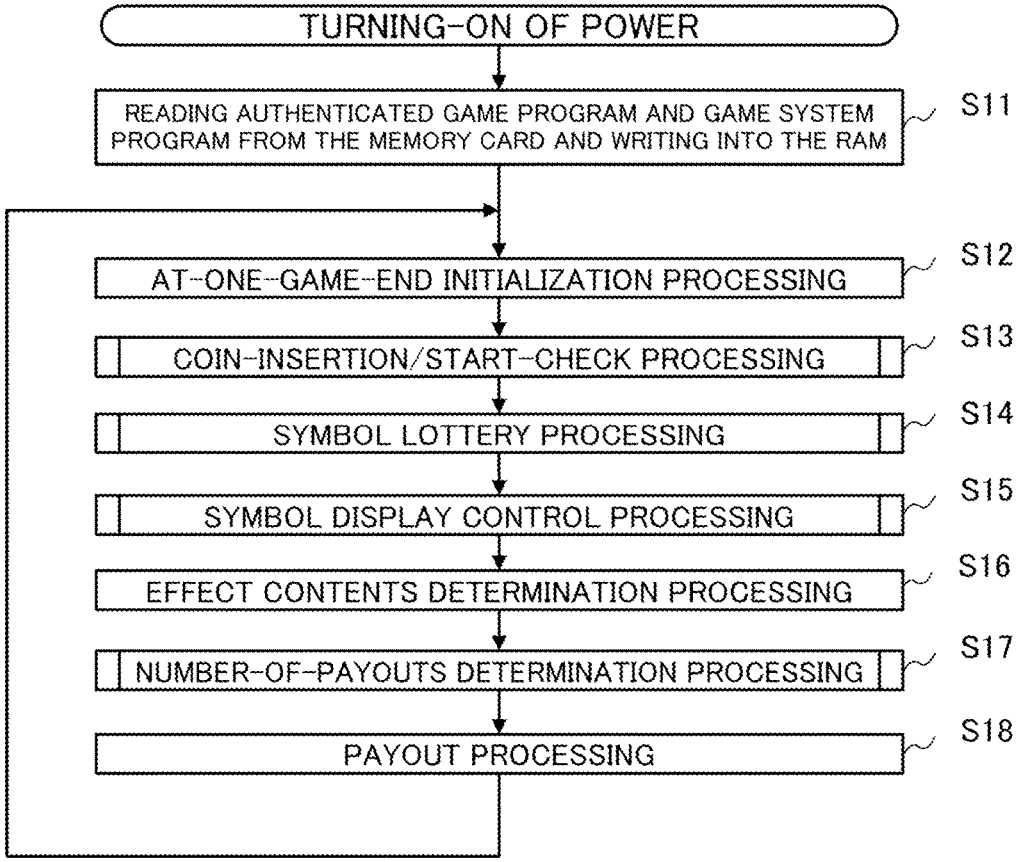
FIG. 10 is a view illustrating a flowchart of main control processing for the gaming machine.

First, with reference to FIG. 10, main control processing is described. FIG. 10 is a view illustrating a flowchart of the main control processing for the gaming machine 1 according to the embodiment of the present invention.

First, when the power is supplied to the gaming machine 1, the main CPU 71 reads the authenticated game program and game system program from the memory card 54 through the gaming board 50, and writes the programs into the RAM 73 (step S11).

Next, the main CPU 71 conducts at-one-game-end initialization processing (step S12). For example, data that becomes unnecessary after each game in the working areas of the RAM 73, such as the number of BETs and the symbols determined by lottery, is cleared.

Next, the input/credit check processing portion 301 which is executed by the main CPU 71 is conducts coin-insertion/start-check processing which is described later with reference to FIG. 11 (step S13). In the processing, input from the BET switch and the spin switch are checked.

Next, the symbol determination processing portion 303 which is executed by the main CPU 71 is conducts symbol lottery processing which is described later with reference to FIG. 13 (step S14). In the processing, to-be stopped symbols are determined based on the random values for symbol determination. Further, the winning determination processing portion 304 which is executed by the main CPU 71 determines whether the stopped symbols determined by the symbol determination processing portion 303 is a match with a predetermined winning combination.

Next, the symbol display control portion 306 which is executed by the main CPU 71 is conducts symbol display control processing which is described later with reference to FIG. 14 (step S15). In the processing, scrolling of the symbol array of each video reel 3 is started, and the to-be stopped symbol determined in the symbol lottery processing of step S14 is stopped at a predetermined position (e.g. the upper region in the symbol display region 4). That is, three symbols including the to-be stopped symbol are displayed in the symbol display region 4. For example, when the to-be stopped symbol is the symbol that is associated with the code number of "10" and it is to be displayed to the upper region, the symbols associated with the respective code numbers of "11" and "12" are to be displayed to the respective middle region and lower region in the symbol display region 4.

Next, the effect control processing portion 307 that is executed by the main CPU 71 is conducts effect contents determination processing (step S16). The main CPU 31 extracts a random value for effect, and determines any of the effect contents from the preset plurality of effect contents by lottery. Further, the effect control processing portion 307 executes an effect corresponding to the winning combination, in accordance with the instruction of the winning determination processing portion 304 and, executes an effect corresponding in response to the touch operation of the player from the lower image display panel 141 operating as a touch panel. Further, the effect control processing portion 307 controls to display an effect image including the title logo or the jackpot amount on the upper image display panel 131. For convenience, the effect contents determination and execution process is shown to be read after the symbol display processing in step S15 is completed, but can be read and executed as appropriate in the course of the symbol display control process.

Next, the payout processing portion 305 which is executed by the main CPU 71 is conducts number-of-payouts determination processing which is described later with reference to FIG. 16 (step S17). In the processing, the number of payouts is determined based on the combination of symbols displayed on the winning lines L (pay lines 300), and is stored into a number-of-payouts storage area (a number-of-payouts counter) provided in the RAM 73.

Next, the main CPU 71 conducts payout processing (step S18). The main CPU 71 adds the value stored in the number-of-payouts storage area (a number-of-payouts counter) to a number-of-credits storage area (a number-of-credits counter) provided in the RAM 73. It is to be noted that operations of the hopper 113 may be controlled based on input from the CASHOUT switch 33S, and coins of the number corresponding to the value of the number-of-credits counter may be discharged from the coin payout exit 15A. Further, operations of the ticket printer 171 may be controlled and a ticket with a barcode may be issued on which a value stored in the number-of-credits counter is recorded. After the processing has been conducted, the processing is shifted to step S12.

<Coin-Insertion/Start-Check Processing>

Figure 11:
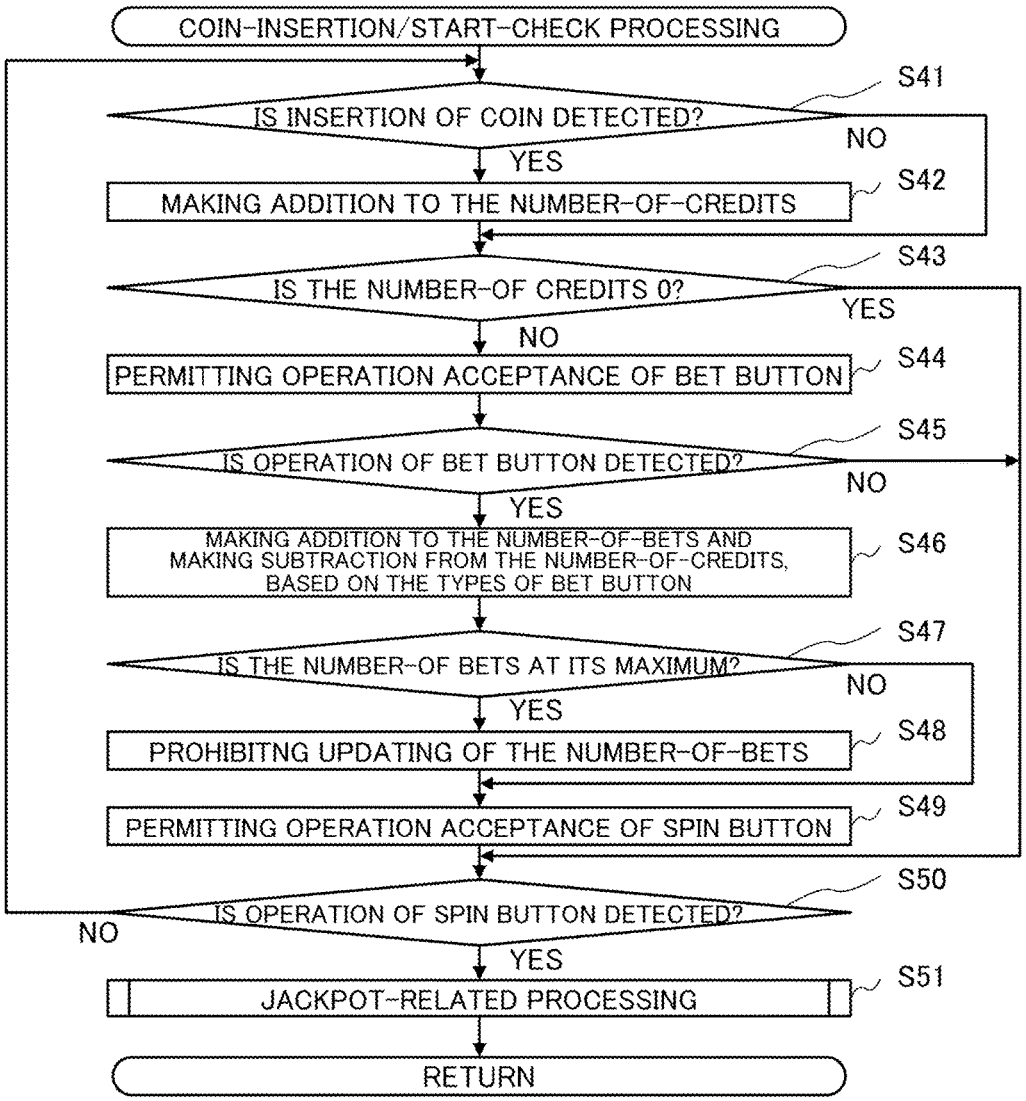
FIG. 11 is a flowchart illustrating coin-insertion/start-check processing for the gaming machine.

Next, with reference to FIG. 11, coin-insertion/start-check processing is described. FIG. 11 is a view illustrating a flowchart of the coin-insertion/start-check processing for the gaming machine according to the embodiment of the present invention.

First, the main CPU 71 determines whether or not insertion of a coin has been detected by the coin counter 92C (step S41). When determining that the insertion of a coin has been detected, the main CPU 71 makes an addition to the number-of-credits storage area (step S42). It is to be noted that, in addition to the insertion of a coin, the main CPU 71 may determine whether or not insertion of a bill has been detected by the bill validator 115, and when determining that the insertion of a bill has been detected, the main CPU 71 may add a value according to the bill to the number-of-credits storage area.

After step S42 or when determining in step S41 that the insertion of a coin has not been detected, the main CPU 71 determines whether or not the number-of-credits storage area is zero (step S43). When the main CPU 71 determines that the number-of-credits storage area is not zero, the main CPU 71 permits operation acceptance of the BET buttons (step S44).

Next, the main CPU 71 determines whether or not operation of any of the BET buttons has been detected (step S45). When the main CPU 71 determines that the BET switch has detected press of the BET button by the player, the main CPU 71 makes an addition to a number-of-BETs storage area provided in the RAM 73 and makes a subtraction from the number-of-credits storage area, based on the type of the BET button (step S46).

Next, the main CPU 71 then determines whether or not the number-of-BETs storage area is at its maximum (step S47). When the main CPU 71 determines that the number-of-BETs storage area is at its maximum, the main CPU 71 prohibits updating of the number-of-BETs storage area (step S48). After step S48 or when determining in step S47 that the number-of-BETs storage area is not at its maximum, the main CPU 71 permits operation acceptance of the spin button (step S49).

After step S49 or when determining in step S45 that the operation of any of the BET buttons has not been detected, or when determining in step S43 that the number-of-credits storage area is zero, the main CPU 71 determines whether or not operation of the spin button has been detected (step S50). When the main CPU 71 determines that the operation of the spin button has not been detected, the processing is shifted to step S41.

When the main CPU 71 determines that the operation of the spin button has been detected, the main CPU 71 conducts jackpot-related processing which is described later with reference to FIG. 12 (step S51). In the processing, the amount to be accumulated to the amount of jackpot (accumulated amount) is calculated, and the jackpot amount and the accumulated amount are added, it is stored jackpot amount storage area (jackpot amount counter). After the processing has been conducted, the coin-insertion/start-check processing is completed.

<Jackpot-Related Processing>

Figure 12:
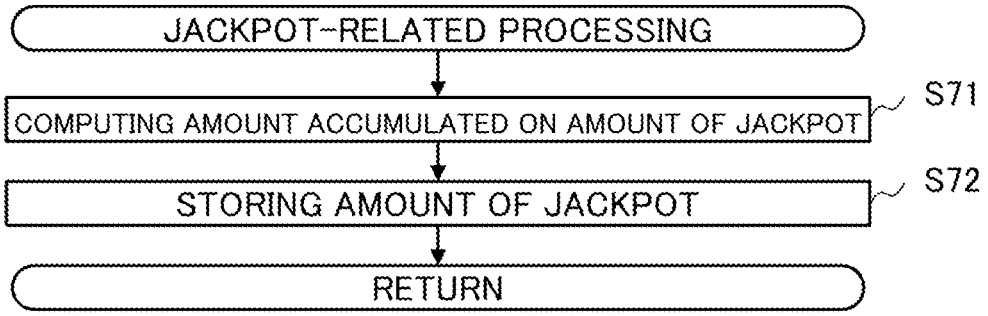
FIG. 12 is a view illustrating a flowchart of jackpot-related processing for the gaming machine.

Next, with reference to FIG. 12, the jackpot-related processing is described. FIG. 12 is a view illustrating a flowchart of the jackpot-related processing for the gaming machine 1 according to the embodiment of the present invention.

First, the main CPU 71 calculates the amount to be accumulated to the amount of jackpot for accumulation (step S71). The main CPU 71, example obtains the product of the value stored in the number-of-BETs storage area and a preset accumulation ratio, so that the amount for accumulation to the amount of jackpot is calculated.

Next, the main CPU 71 adds the jackpot amount and the amount to be accumulated to amount of jackpot has been calculated, and then stores in the (jackpot amount counter) jackpot amount storage area (step S72). After the processing has been conducted, the jackpot-related processing is completed. It should be noted that if the jackpot is a network type, the amount of accumulated to amount of jackpot is transmitted to the external control unit 200. Upon reception of the amount for accumulation to the jackpot amount, the external control device 200 updates the amount of jackpot.

<Symbol Lottery Processing>

Figure 13:
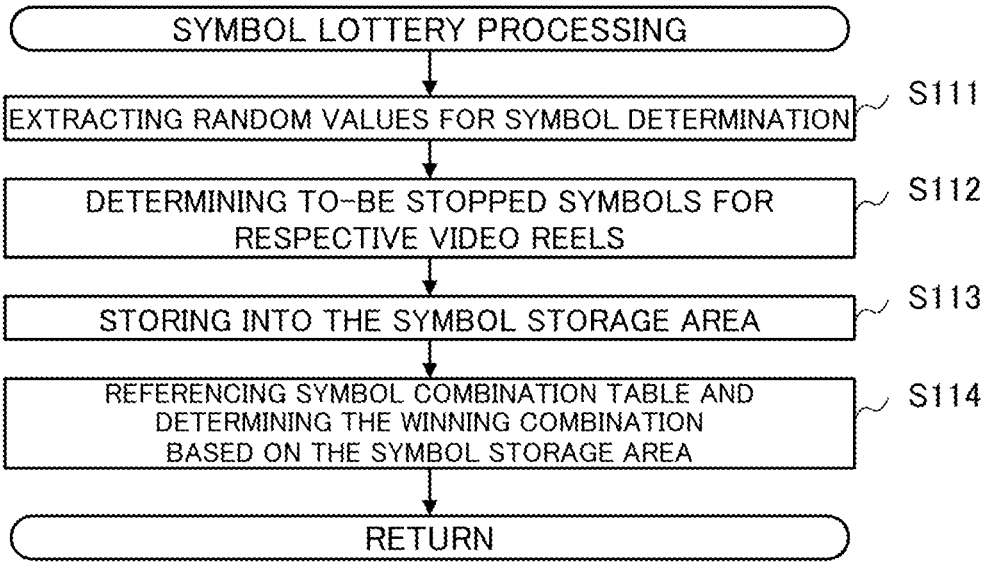
FIG. 13 is a view illustrating a flowchart of symbol lottery processing for the gaming machine.

Next, with reference to FIG. 13, the symbol lottery processing is described. FIG. 13 is a view illustrating a flowchart of the symbol lottery processing for the gaming machine 1 according to the embodiment of the present invention.

First, the main CPU 71 extracts random values for symbol determination (step S111). The main CPU 71 then determines to-be stopped symbols for the respective video reels 3 by lottery (step S112). The main CPU 71 holds a lottery for each video reel 3, and determines any one of the 21 symbols (code numbers from "00" to "20") as a to-be-stopped symbol. At this time, each of the 21 symbols (code numbers from "00" to "20") is determined at an equal probability (i.e. 1/21).

The main CPU 71 then stores the determined to-be-stopped symbols for the respective video reels 3 into a symbol storage area provided in the RAM 73 (step S113). Next, the main CPU 71 references the symbol combination table (FIG. 8) and determines a winning combination based on the symbol storage area (step S114). The main CPU 71 determines the winning combination based on the combination of symbols to be displayed along the winning line by the respective video reels 3 and the combination of symbols on the symbol combination table. After the processing has been conducted, the symbol lottery processing is completed.

<Symbol Display Control Processing>

Figure 14:
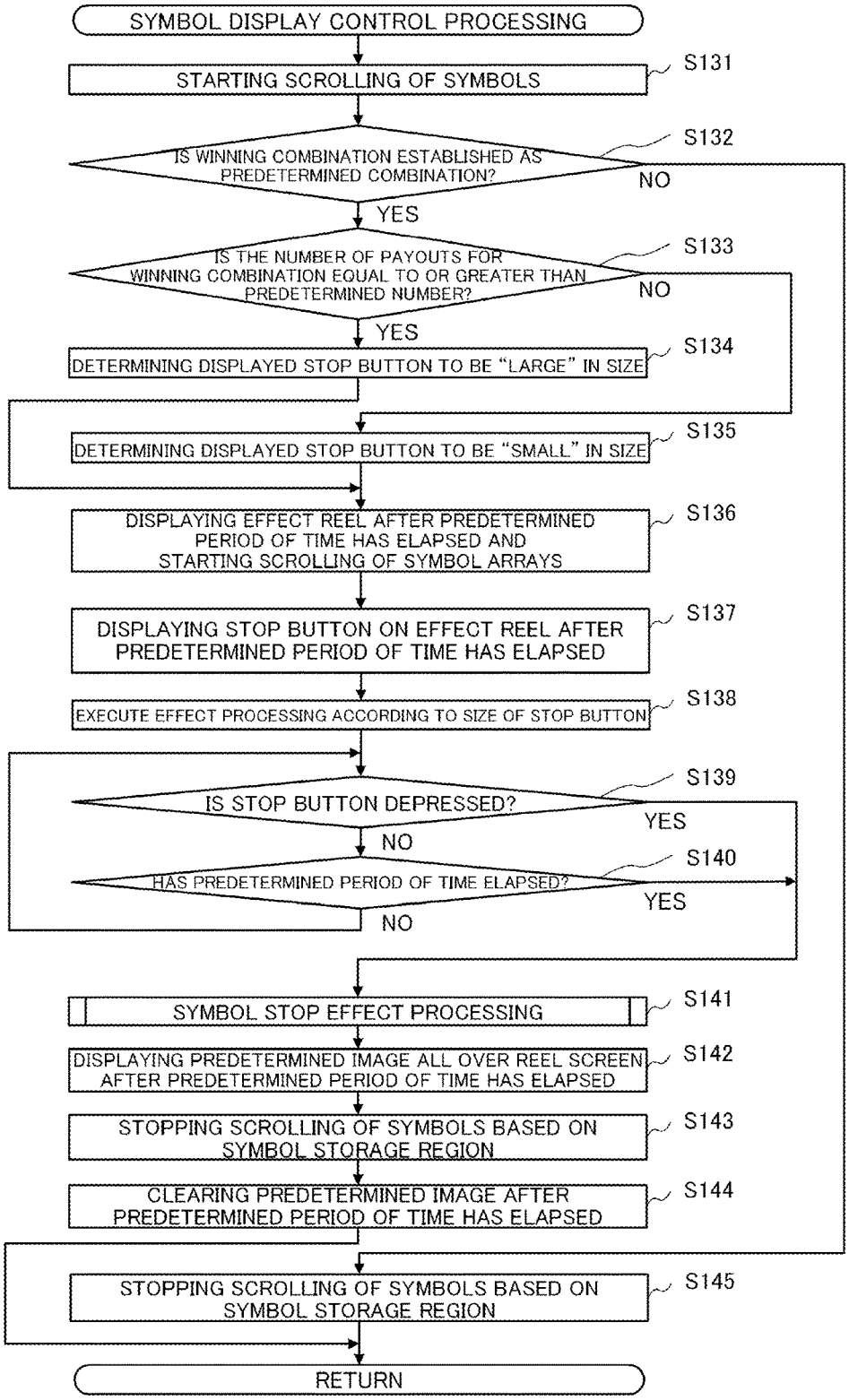
FIG. 14 is a view illustrating a flowchart of symbol display control processing for the gaming machine.

Next, with reference to FIG. 14, FIG. 15, and FIGS. 17 to 23, the symbol display control processing is described. FIG. 14 is a view illustrating a flowchart of the symbol display control processing for the gaming machine 1 according to the embodiment of the present invention.

Figure 17A:
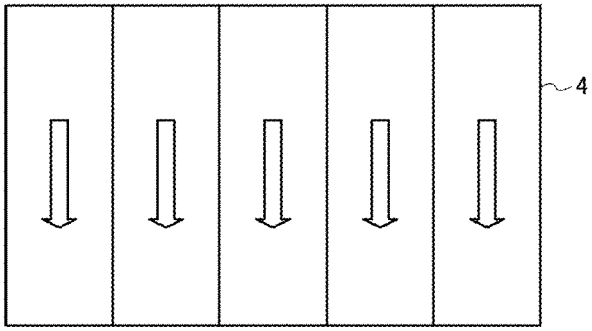
FIGS. 17A to 17D are views illustrating a display mode of an effect reel in the gaming machine.

First, the main CPU 71 starts scrolling of symbol arrays of a respective one of video reels 3 that are displayed in a symbol display region (step S131). FIG. 17A shows a state in which symbol arrays of the first to fifth video reels 3*a* to 3*e* are respectively scrolled in a downward direction in the symbol display region 4 of the lower image display panel 141.

Next, the main CPU 71 determines whether a determined winning combination is established as a predetermined combination (step S132). The predetermined combination include a case in which symbols of a same kind are rearranged on a winning line for all of the reels (the first to fifth video reels 3*a* to 3*e*) on a winning line or a case in which the winning combination is a combination relevant to a jackpot (or a part of the combination relevant to the jackpot), for example. In the case where a combination other than the predetermined combination (including a case of "losing") is established, scrolling of symbol arrays on a respective one of the video reels 3 is stopped so that to-be-stopped symbols stop at to-be-stopped positions, based on the symbol storage region described previously (step S145). When this processing is conducted, symbol display control processing is completed.

In the case where the winning combination is established as the predetermined combination in step S132, it is further determined that the number of payouts for the winning combination is equal to or greater than a predetermined number (step S133). For example, with reference to the symbol combination table, in the case where four ORANGE symbols are rearranged on a winning line, the winning combination is established as "ORANGE 4", and the number of payouts is obtained as 80. In the case where five ORANGE symbols are rearranged on a winning line, the winning combination is established as "ORANGES", and the number of payouts is obtained as 400. If the predetermined number is set to 100, in the case where the winning combination is established as "ORANGE 5", it is determined that the number of payouts is equal to or greater than a predetermined number, or alternatively, in the case where the winning combination is established as "ORANGE 4", it is determined that the number of payouts is not equal to or greater than the predetermined number.

In the case where it is determined that the number of payouts for the winning combination is equal to or greater than the predetermined number in step S133, a size of a stop button that is displayed on an effect reel to be described later is determined so as to be set to "large" (step S134). On the other hand, in the case where it is determined the number of payouts for the winning combination is not equal to or greater than the predetermined number, the size of the stop button that is displayed on the effect reel to be described later is determined so as to be set to "small" (step S135). In this example, although whether the size of the stop button is large or small is determined depending on whether the number of payouts is greater or smaller than one predetermined number, a configuration may be made in such a manner that winning combinations are classified into more groups in accordance with a plurality of predetermined numbers, and the size of the stop button is set so as to change relative to a respective one of the groups. In addition, a configuration can also be made in such a manner as to change the size of the stop button in accordance with the winning combinations themselves and another standard relevant thereto.

When determination of the size of the stop button is completed, after a predetermined period of time has elapsed after scrolling of the symbol arrays on the video reels 3 has been started in step S131, an effect reel is displayed in a symbol display region, and scrolling of the symbol arrays of the effect reel is started (step S136). FIG. 7 (B) shows a state in which the effect reel is displayed in the effect reel display region 410 of the lower image display panel 141, and the symbol arrays on the effect reel are scrolled as usual in a downward direction. On the effect reel, the symbol arrays including the PLUM symbol 411 and the ORANGE symbol 412 are displayed in a scrolled state.

Figure 17B:
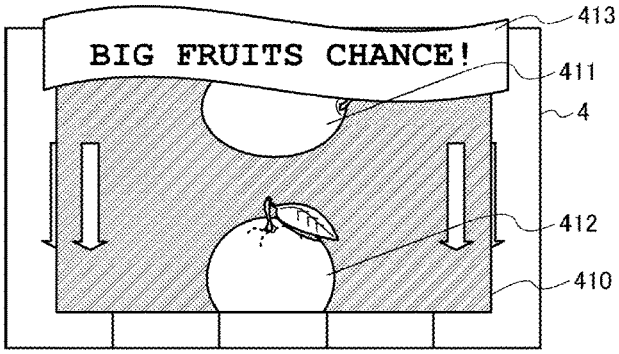

In an example shown in FIG. 17B, the effect reel display region 410 is configured so as to be smaller in size than the display of the symbol arrays on the first to fifth video reels 3*a* to 3*e* (the symbol display region 4), and is also configured so that an end part of the symbol arrays on the video reels 3*a* to 3*e* can be seen at the periphery of the effect reel display region 410. Also, at an upper part of the effect reel display region 410, as shown in FIG. 17B, a logo display 413 relevant to this effect reel (in this example, display of "BIG FRUITS CHANGE!") may be configured so as to be displayed.

The effect reel display region 410 can also be configured so that its related size is greater than or the same as that of the display of the symbol arrays on the video reels 3*a* to 3*e*. In addition, although the effect reels are displayed so as to be overlapped on the display of the symbol arrays on the video reels 3*a* to 3*e*, and are configured so that the symbol arrays on the video reels 3*a* to 3*e* on the backside cannot be seen at a display portion of the effect reel, the effect reel can also be configured as a transparent display so that the symbol arrays on the video reels 3*a* to 3*e* on the backside can be seen. Furthermore, the effect reel can also be configured so as to be displayed in a region that is different from the display of the symbol arrays on the video reels 3*a* to 3*e*.

Although the symbol arrays that are displayed on the effect reel shown in FIG. 17B are symbol arrays including the PLUM symbol 411 and the ORANGE symbol 412, as described above, an array which is the same as any one of the symbol arrays on the video reels 3*a* to 3*e* may be provided. It is to be noted that the symbols of the symbol arrays that are displayed on the effect reel are greater in size than the symbols of the symbol arrays on the video reels 3*a* to 3*e*. In addition, although one symbol array is displayed so as to be scrolled on the effect reel, two or more symbol arrays to be displayed can also be set.

Next, after a predetermined period of time has elapsed, the stop button that is set in size in step S134 or step S135 is displayed on the effect reel (step S137). That is, in the case where a winning combination is established as a predetermined combination and the number of payouts for the winning combination is equal to or greater than a predetermined number, a stop button of a large size is displayed, or alternatively, in the case where the winning combination is established as the predetermined combination and in the case where the number of payouts for the winning combination is less than the predetermined number, a stop button which is smaller in size than the stop button mentioned above is displayed.

Figure 17C:
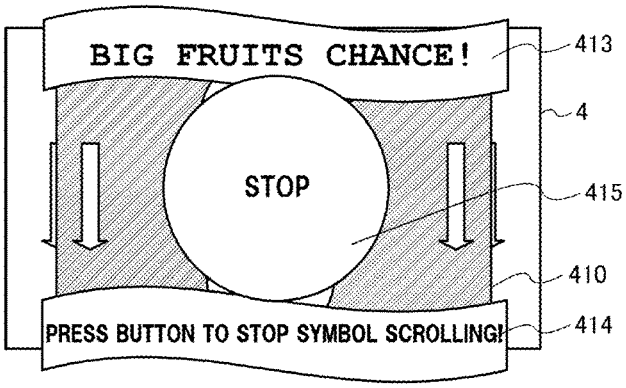

FIG. 17C shows a state in which a stop button of a large size is displayed in the effect reel display region 410. Also, in this state, the symbol arrays on the effect reel continue scrolling in a downward direction. Further, on the backside, control may be effected so that an end part (a display portion) of the symbol arrays on the video reels 3*a* to 3*e* is displayed in a scrolled state.

Figure 17D:
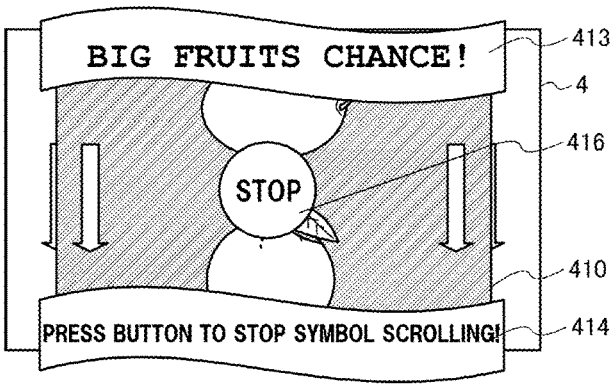

FIG. 17D shows a state in which a stop button of a small size is displayed in the effect reel display region 410. Also, in this state, the symbol arrays on the effect reel continue scrolling in a downward direction. Further, on the backside, control may be effected so that the end part (the display portion) of the symbol arrays on the video reels 3*a* to 3*e* is displayed in a scrolled state.

In the case where a stop button is displayed, as shown in FIG. 17C and FIG. 17D, a guide display 414 that prompts a player to depress the stop button (in this example, a message display of "PRESS THE BUTTON TO STOP SYMBOL SCROLLING") may be configured so as to be displayed at a lower part of the effect reel display region 410.

Next, effect processing is executed according to the size of the stop button (step S138). For example, in the case where the stop button of the large size is displayed, such displaying is controlled so as to reproduce a sound corresponding to the large size by the speaker 112, or alternatively, in the case where the stop button of the small size is displayed, such displaying is controlled so that a sound corresponding to the small size is thereby reproduced.

Next, it is determined whether or not the stop button is pressed by a player (step S139). Then, it is determined whether or not a predetermined period of time has elapsed (step S140), and the determination of step S139 is repeated until the predetermined period of time has elapsed. In the case where the stop button is pressed, or alternatively, in the case where the predetermined period of time has elapsed, symbol stop effect processing is conducted, and scrolling of the symbol arrays on the effect reel is stopped by predetermined symbol stop effect processing (step S141). Although depressing of the stop button by the player is achieved by the player touching the stop button that is displayed on the lower image display panel 141 configured as a touch panel, such depressing may be achieved by pressing one of the BET buttons or the spin button.

Figure 18A:
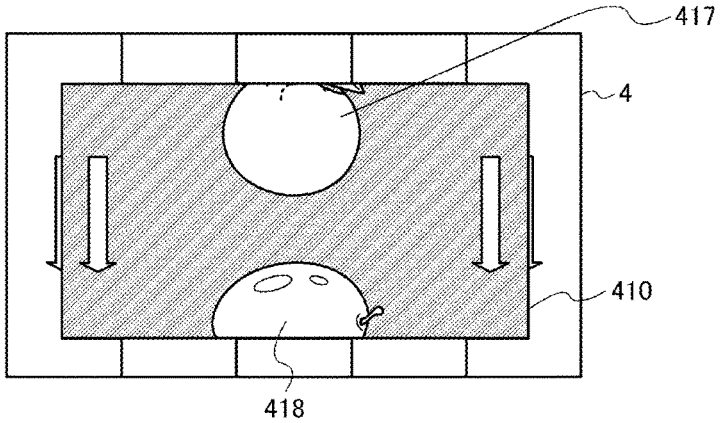
FIGS. 18A to 18D are views illustrating a display mode of an effect reel in the gaming machine.
Figure 18B:
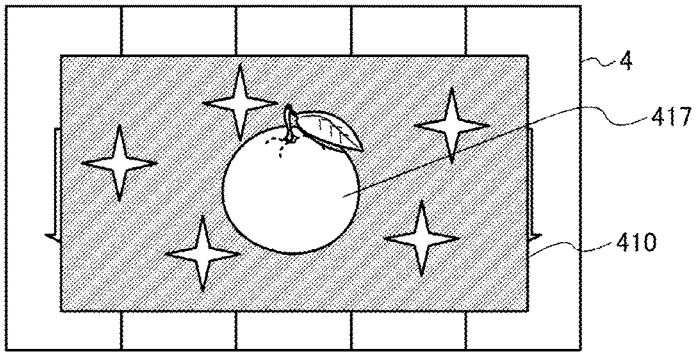

FIG. 18A illustrates a state immediately before the effect reel displayed in the effect reel display region 410 stops scrolling in a downward direction by pressing the stop button. This example shows an external view representative of the fact that the PLUM symbol 418 moves in a downward direction, and is disappearing from the effect reel display region 410, and that the ORANGE symbol 417 appears from an upper part of the effect reel display region 410. FIG. 18B shows a state in which scrolling of the effect reel completely stops subsequent to the state shown in FIG. 18A. In this example, the ORANGE symbol 417 is displayed in a stopped state at a center of the effect reel (the to-be-stopped position), and a plurality of star-shaped graphic patterns having four apexes are shown. These star-shaped graphic patterns may be controlled so as to be displayed in a blinking state. This example shows the effect reel in the case where five ORANGE symbols are rearranged on a winning line, that is, in the case where "ORANGE 5" is established as a winning combination, and on the effect reel, the symbols that are associated with the winning combination (for example, ORANGE symbols which are the same graphic patterns as the above) are thus displayed.

It is to be noted that, although in this example, ORANGE symbols that are the same graphic patterns as the symbols that are displayed in the symbol display region 4 (herein, referred to as the winning combination "ORANGE 5") are employed as symbols to be displayed in a stopped state on the effect reel, any symbol may be displayed in a stopped state on the effect reel as long as it has a predetermined relevancy. For example, the symbol may be obtained as an object having its predetermined common features such as another fruits that is citrus fruits identical to orange or another object of which a color is similar to an orange color, or alternatively, another similar object formed in a circular shape. In addition, it is sufficient if such an object can be represented as a symbol, and it is also sufficient even if a target to be displayed is not specified as an object. Further, there can be provided a symbol that is representative of a part of a respective one of the symbols that are displayed in the symbol display region 4 (for example, a symbol that is associated with a winning combination), a symbol including a portion of a respective one of the displayed symbols, a symbol that is linked with the symbol based on a predetermined conceptual idea, or a symbol or the like having relevancy with the displayed symbols in setting or story in a gaming machine, and these symbols may be displayed in a stopped state on the effect reel.

In addition, a symbol that is associated with a plurality of symbols that are displayed in the symbol display region 4 may be displayed in a stopped state on the effect reel. For example, in the case where a winning combination is established as "ORANGE 3" and symbols of three kinds are rearranged on a winning line together with other two symbols, an object conceived from graphic patterns that are represented by these three symbols, or alternatively, a symbol having a common feature can also be displayed in a stopped state on the effect reel.

Figure 18C:
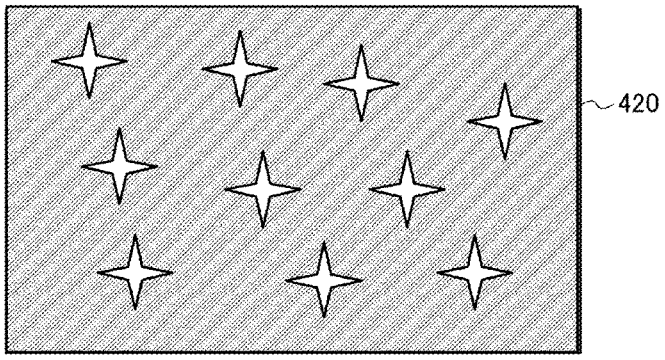

Next, after a predetermined period of time has elapsed, a predetermined image is displayed all over the display of the symbol arrays on the first to fifth video reels 3*a* to 3*e* (step S142). For example, as shown in FIG. 18C, an image 420 including a plurality of star-shaped graphic patterns having four apexes is displayed in the symbol display region 4 of the lower image display panel 141. In this example, although the size of the image 420 is the same as a display size of the symbol arrays on the video reels 3*a* to 3*e*, the size of this image can be set at an arbitrary size. However, it is desirable that the image 420 be configured so as to cover all or almost all over the display of the symbol arrays on the video reels 3*a* to 3*e* so that the symbol arrays on the video reels 3*a* to 3*e* can be seen at once at the same time when the image 420 is cleared. Also, the image 420 may be a motion picture produced in such a manner that the star-shaped graphic patterns move or blink.

Next, based on the symbol storage region described previously, scrolling of the symbol arrays on a respective one of the video reels 3 is stopped so that the to-be-stopped symbols stop at the to-be-stopped positions (step S143). It is to be noted that at this time point, the symbol arrays on the video reels 3 are not displayed because the symbol display region 4 of the lower image display panel 141 is established in a state in which the image 420 is displayed as described above. Therefore, the processing operation of step S143 is actually directed to a processing operation of preparing an image in a video RAM or the like, the image being indicative of a state in which the symbol arrays on the video reels 3 stop.

Figure 18D:
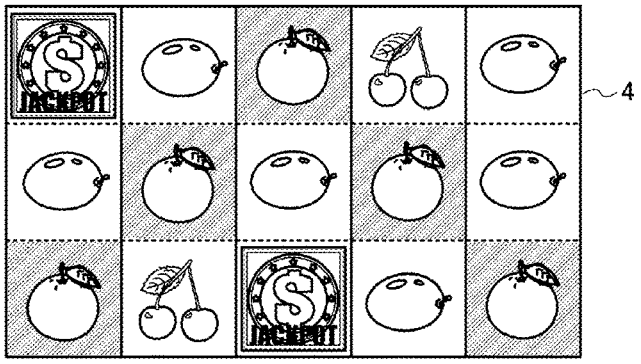

Next, after a predetermined period of time has elapsed, the image 420 is cleared (step S144), and then, symbol display control processing is completed. By clearing this image 420, the image that is indicative of the state in which the symbol arrays on the respective one of the video reels 3 stop, the image having been prepared in step S143, is displayed in the symbol display region 4 of the lower image display panel 141, thus enabling a player to be aware of what kind of symbols will stop on the respective one of the video reels 3 and what winning combination will be established. For example, although FIG. 18D shows a state in which the symbol arrays on the respective one of the video reels 3 stop, and in the figure, it is possible to recognize that five ORANGE symbols are rearranged on a winning line, that is, the winning combination "ORANGE 5" is established.

Whether or not the effect reel is displayed is different depending on a winning combination, and further, the size of the stop button that is displayed on the effect reel or effect processing is also different depending on the number of payouts for the winning combination; and therefore, by providing such a sign, it becomes possible for a player to feel a sense of expectation for a lottery result or to be given a tense atmosphere for the play of a game. Also, the player can estimate or predict which winning combination will be established during a period of time from a time point at which the symbol arrays on the respective one of the video reels 3 stop to a time point at which a winning combination is established, whereby the player can enjoy a variety of game playing patterns, making it possible to enhance an interest for the play of a game.

In addition, in the case where the number of payouts for the winning combination is equal to or greater than a predetermined number and a stop button of a large size is displayed, there can take place a situation in which the symbols of the symbol arrays on the effect reel are hardly visually recognized owing to the displayed stop button (for example, as shown in FIG. 17C). In this manner, with respect to a winning combination, the number of payouts of which is large, there takes place a situation in which it becomes more difficult for a player to press the stop button with a well-aimed timing with which predetermined symbols are to be rearranged (that is, well-aimed pressing becomes more difficult), and the player's interest for the play of a game can be enhanced more remarkably. On the other hand, in the case where the number of payouts for the winning combination is smaller than the predetermined number and a stop button of a small size is displayed, there does not take place a situation in which the symbols of the symbol arrays on the effect reel are hardly visually recognized owing to the displayed stop button (for example, as shown in FIG. 17D), and with respect to a winning combination of which the number of payouts is small, well-aimed pressing is comparatively easy. Thus, a configuration is made in such a manner that well-aimed pressing is difficult with respect to the winning combination of which the number of payouts is large, whereas in the embodiment, even if the stop button is pressed with any timing, the symbols of the effect reel to be finally displayed and the to-be-stopped positions of the symbols on the video reels 3 do not change, and any winning combination does not change.

Of course, a difficulty in well-aimed pressing can also be configured so as to be changed according to the number of payouts for the winning combination. In addition, settings of the lower image display panel 141 that is configured as a touch panel are changed, and according to the size of the stop button, it is possible to change an area of a detection region in which a player's touch operation can be detected. For example, a display region of the stop button and the detection region of the touch operation can be configured so as to be substantially coincident with each other. With such a configuration, the touch operation of the stop button can be made easier as the number of payouts for the winning combination increases. In addition, in the case where the display region of the stop button is large, the detection region of the touch operation is reduced in size, whereby the touch operation of the stop button becomes more difficult as the number of payouts for the winning combination increases. Further, the stop button is configured in a semi-transparent button display mode, thereby making it possible to establish a state in which the symbol arrays on the effect reel on the backside are easily visually recognized as well.

Figure 15:
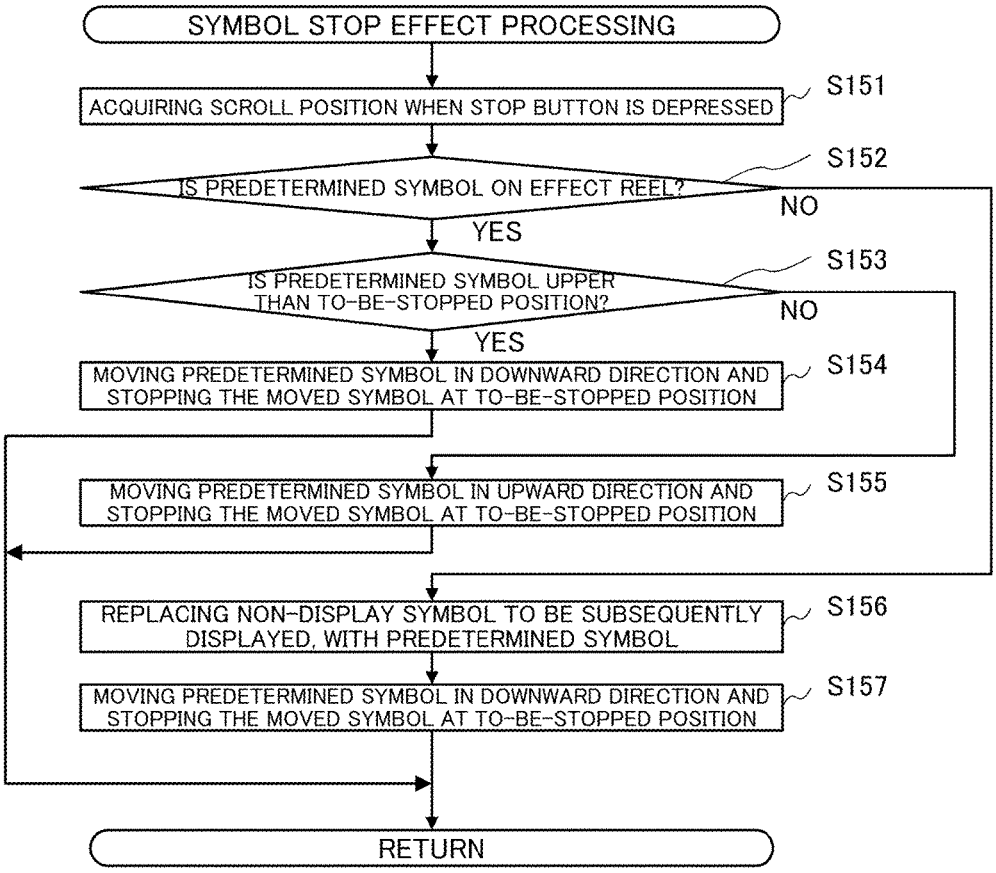
FIG. 15 is a view illustrating a flowchart of symbol stop effect processing in a gaming machine.

Next, with reference to FIG. 15 and FIG. 19A to FIG. 22B, symbol stop effect processing will be described. FIG. 15 is a view illustrating a flowchart of symbol stop effect processing in a gaming machine 1 according to the embodiment of the present invention. An effect control processing portion 307 executed by a main CPU 71 controls a display mode that is associated with a symbol stop display, so as to be switched according to a timing with which a stop button is pressed by a player.

The symbol stop effect processing is executed in the case where the stop button is pressed by the player, or alternatively, in the case where a predetermined period of time has elapsed without the stop button being pressed, as shown in FIG. 14 (step S141). First, the user acquires scroll positions of symbol arrays on an effect reel at a time point at which the stop button is pressed (step S151). In this manner, the user attempts to keep track of which positions of the symbol arrays on the effect reel are set, when the stop button is pressed, for example. In addition, the player can actually keep track of these scroll positions by recognizing which position of a specific symbol is set in an effect reel display region 410, or alternatively, which symbol is set at a specific position of the effect reel display region 410.

Next, it is determined whether or not a predetermined symbol (for example, an ORANGE symbol which is the same graphic pattern as that associated with a winning combination, as shown in FIG. 18B) is displayed on the effect reel (step S152). The ORANGE symbol is established in a displayed state as long as even a part of the ORANGE symbol can be seen in the effect reel display region 410.

Figure 19A:
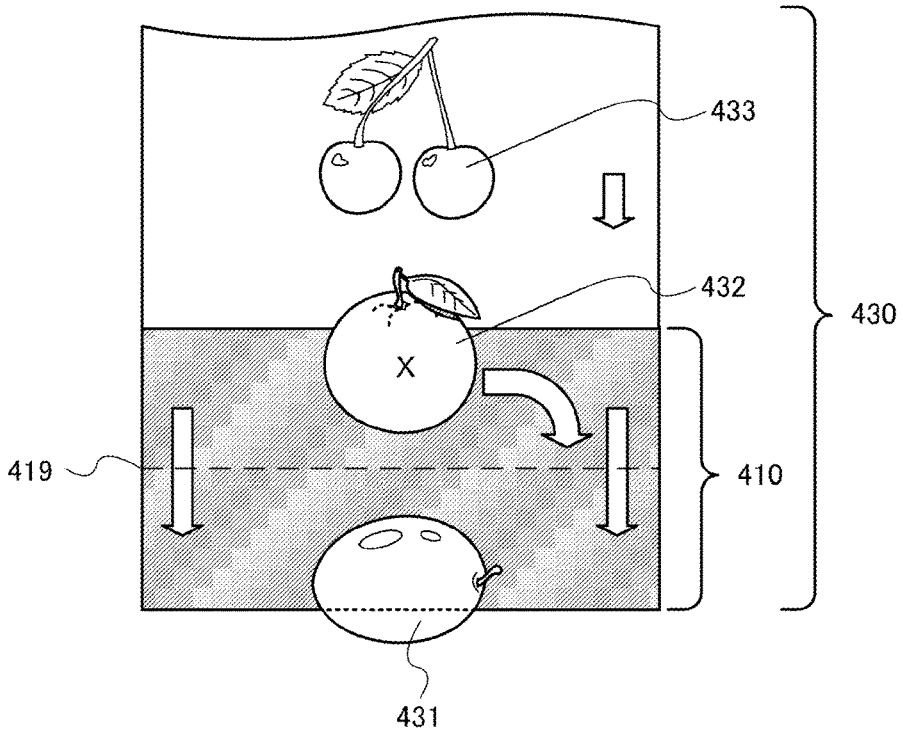
FIGS. 19A and 19B are views illustrating a pattern of a symbol stop effect in an effect reel of the gaming machine.

FIG. 19A shows the effect reel display region 410 as a range that can be visually recognized by a player and an image 430 of symbol arrays that include a symbol to be displayed with a subsequent timing, for example. The image 430 of the symbol arrays is referred to as an image of symbol arrays that are extensively stored in a video RAM of a graphic board 130, and while the symbol arrays are scrolled, a part of this image is displayed in a sequential order from the top of the effect reel display region 410 on a one by one line basis (on the basis of a one pixel line) in a real time or with a timing close to the real time, and the lower image is shifted to a lower side on the one by one line basis, whereby in the effect reel display region 410, the symbol arrays on the effect reel are displayed as if they were scrolled in a downward direction (a relationship between the reel display region 410 and the image 430 of the symbol arrays is held similarly with respect to FIG. 20A to FIG. 22B as well). Therefore, in an example of FIG. 19A, only a range of the effect reel display region 410 is targeted to be displayed, and the player can see an upper part of an ORANGE symbol 432 and an upper part of a PLUM symbol 431, but cannot see a CHERRY symbol 433.

In the case where it is determined that the predetermined symbol is displayed on the effect reel in step S152, it is determined that the predetermined symbol is upper than a to-be-stopped position (step S153). In the case where the predetermined symbol is upper than the to-be-stopped position, the fact denotes that the predetermined symbol is set on an upper side than the to-be-stopped position at a time point at which the player presses the stop button, and then, the whole symbol arrays are moved in a downward direction and then the moved symbol arrays are controlled so that the predetermined symbol are stopped at the to-be-stopped position (step S154). The predetermined symbol is thus moved in the downward direction subsequently to operation of the stop button by the player, thereby enabling the player to be given such an impression as if the predetermined symbol were stopped at the to-be-stopped position by way of the player's own activity.

Figure 19B:
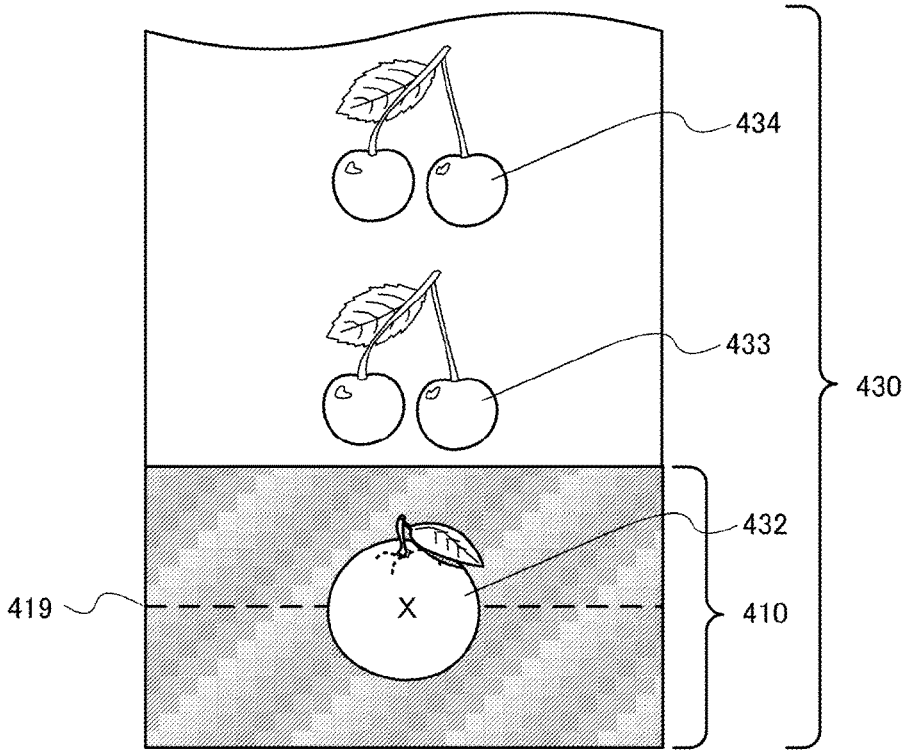

FIG. 19A illustrates the effect reel display 410 and the image 430 of the symbol arrays when the player presses the stop button, as described above. In this example, a predetermined ORANGE symbol 432 is upper than the to-be-stopped position (that is, a center of the ORANGE symbol 432 is upper than the position indicated by a wavy line 419); and therefore, the symbol arrays are moved in the downward direction, and as shown in FIG. 19B, the moved symbol arrays are controlled so that the center of the ORANGE symbol 432 is set at the position indicated by the wavy line 419. It is preferable that such movement of the symbol arrays in the downward direction be achieved by displaying the symbol arrays so as to be slid in a predetermined period of time, and that the predetermined symbol be stopped at the to-be-stopped position (be stopped in a sliding state).

On the other hand, in the case where the predetermined symbol is lower than the to-be-stopped position, the fact denotes that the predetermined symbol passes through the to-be-stopped position, and is rearranged at a lower side of the position; and therefore, the whole symbol arrays are moved in an upward direction and then the moved symbol arrays are controlled so that the predetermined symbol is stopped at the to-be-stopped position (step S155). The predetermined symbol is thus moved in the downward direction subsequently to operation of the stop button by the player, thereby enabling the player to be given such an impression as if the predetermined symbol were stopped at the to-be-stopped position by way of the player's own activity.

Figure 20A:
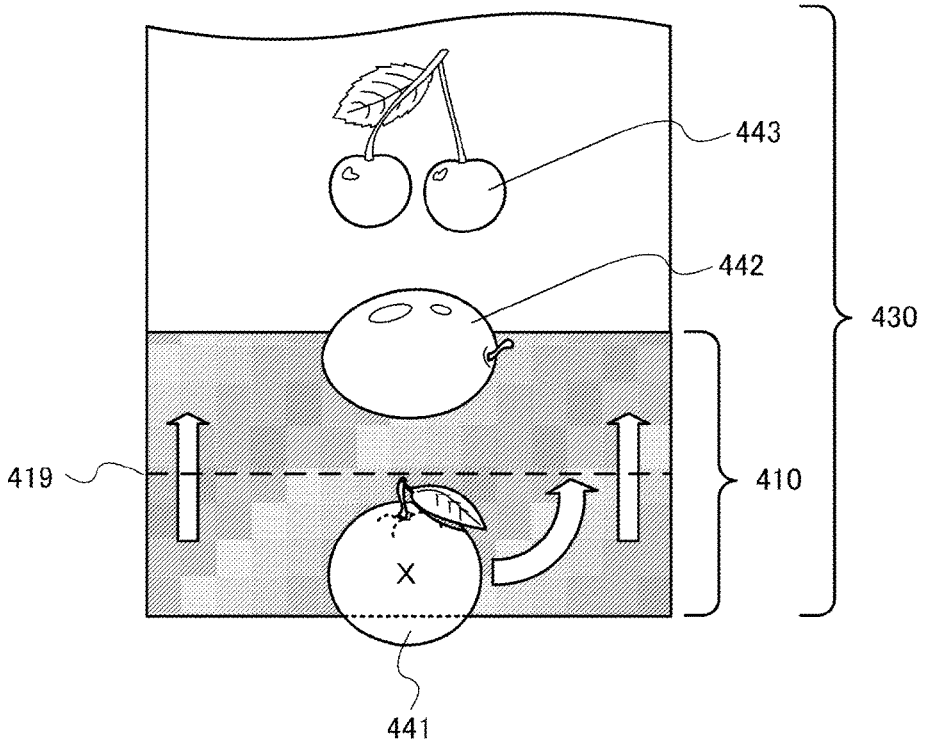
FIGS. 20A and 20B are views illustrating a pattern of a symbol stop effect in an effect reel of the gaming machine.
Figure 20B:
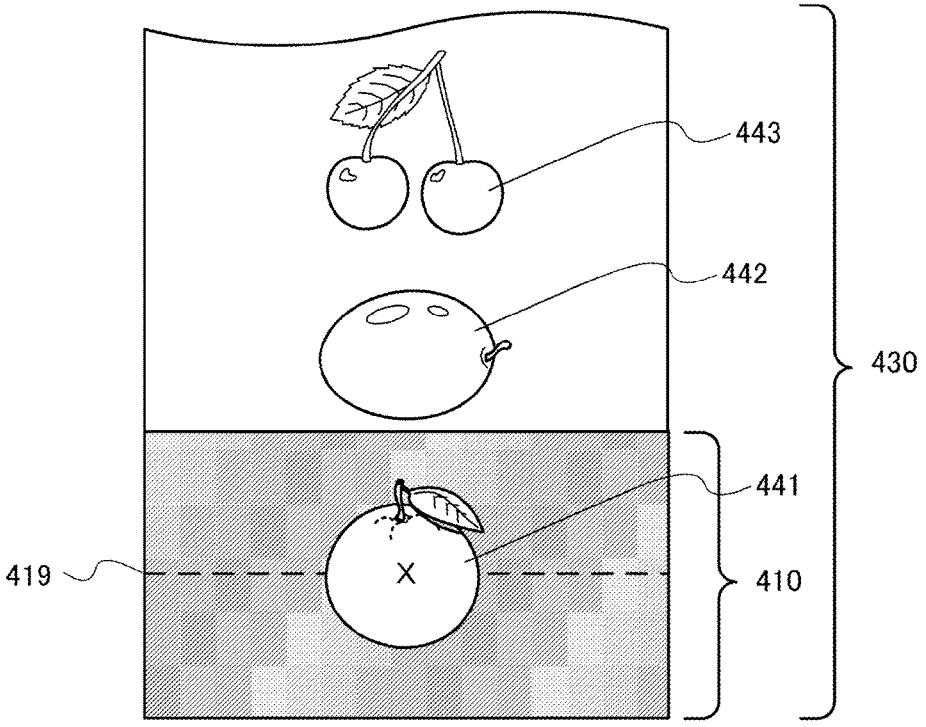

FIG. 20A illustrates the effect reel display 410 and the image 430 of the symbol arrays when the player presses the stop button, as described above. In this example, a predetermined ORANGE symbol 441 is upper than the to-be-stopped position (that is, a center of the ORANGE symbol 441 is upper than the position indicated by a wavy line 419); and therefore, the symbol arrays are moved in the downward direction, and as shown in FIG. 20B, the moved symbol arrays are then controlled so that the center of the ORANGE symbol 441 is set at the position indicated by the wavy line 419. It is preferable that such movement of the symbol arrays in the downward direction be achieved by displaying the symbol arrays so as to be slid in a predetermined period of time, and that the predetermined symbol be stopped at the to-be-stopped position (be stopped in a slidable manner).

In the case where the player thus presses the stop button, if the predetermined symbol that is associated with a winning combination is upper than the to-be-stopped position, the symbol arrays are subsequently scrolled in the downward direction and then the scrolled symbol arrays are stopped in a slidable manner so that the predetermined symbol stops at the to-be-stopped position, or alternatively, if the predetermined symbol is lower than the to-be-stopped position, the symbol arrays are subsequently scrolled in an upper direction (in an opposite direction) and then the scrolled symbol arrays are stopped in a slidable manner so that predetermined symbol stops at the to-be-stopped position.

When the player presses the stop button, in the case where a predetermined symbol that is associated with a winning combination is rearranged just at the to-be-stopped position, scrolling of the symbol arrays on the effect reel is not conducted. In the flowchart of FIG. 15, a description of this feature is omitted here. It is to be noted that the player presses the stop button before keeping track of the winning combination; and therefore, the player cannot keep track of a symbol to be stopped at the to-be-stopped position, and it is very rare that such a situation takes place.

In the case where it is determined that the predetermined symbol is not displayed on the effect reel in step S152, a symbol which is not displayed on the effect reel when the player presses the stop button and which is to be subsequently displayed by scrolling is replaced with the predetermined symbol (step S156). Then, the symbol arrays on the effect reel are scrolled in the downward direction and then the scrolled symbol arrays are controlled so as to stop the predetermined symbol at the to-be-stopped position of the effect reel (step S157).

Figure 21A:
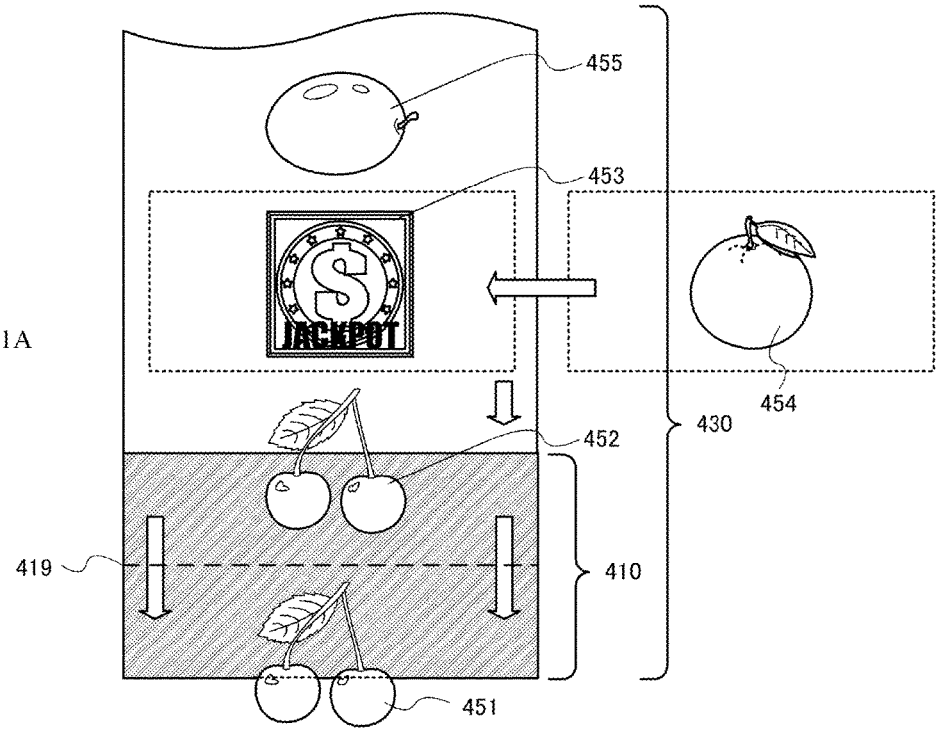
FIGS. 21A and 21B are views illustrating a pattern of a symbol stop effect in an effect reel of the gaming machine.

FIG. 21A illustrates the effect reel display region 410 and the image 430 of symbol arrays when the player presses the stop button. In this example, an ORANGE symbol that is a predetermined symbol is not displayed in the effect reel display region 410, and a CHERRY symbol 452 is upper than the to-be-stopped position, and a symbol to be subsequently displayed is set to a COIN symbol 453. In this case, as shown in FIG. 21B, the COIN symbol 453 is replaced with an ORANGE symbol 454 that is a predetermined symbol and then as shown in FIG. 22A, if the symbol arrays on the effect reel are scrolled in the downward direction, the ORANGE 454 symbol from an upper part of the effect reel display region 410, and finally, the symbol arrays are stopped so that the ORANGE symbol 454, as shown in FIG. 22B, is established in a state in which the symbol stops at the to-be-stopped position (so that a center of the ORANGE symbol 454 is set at the position indicated by the wavy line 419).

It is preferable that such movement of the symbol arrays in the downward direction be achieved by displaying the symbol arrays so as to be slid in a predetermined period of time, and that the predetermined symbol be stopped at the to-be-stopped position (be stopped in a sliding state). By such a replacement with the predetermined image, in the case where the player presses the stop button, the predetermined symbol stops at the to-be-stopped position without an occurrence of an unnatural movement in such a mode that a scroll speed of the effect reel suddenly increases in an attempt to immediately display the predetermined symbol, or alternatively, such that a displayed symbol suddenly changes.

Figure 21B:
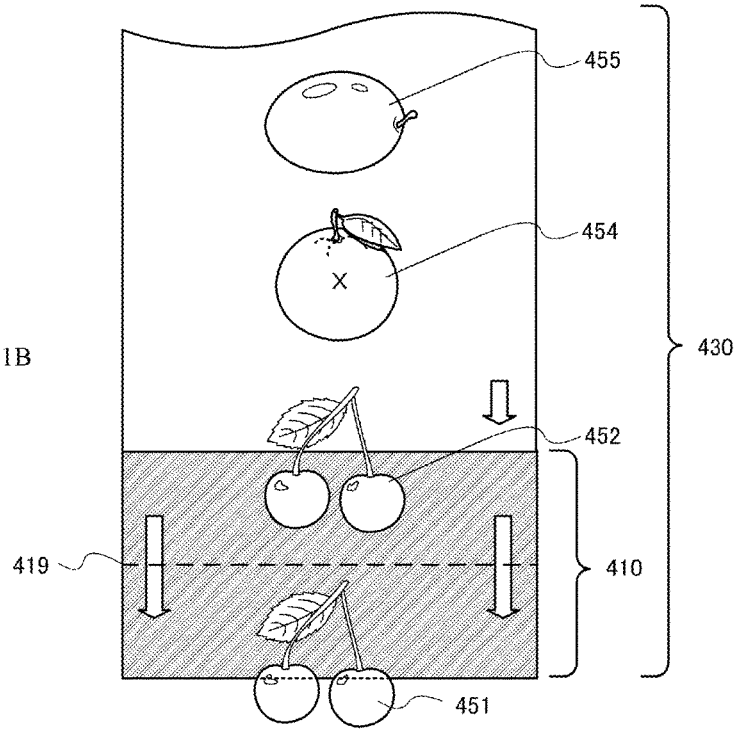
Figure 22A:
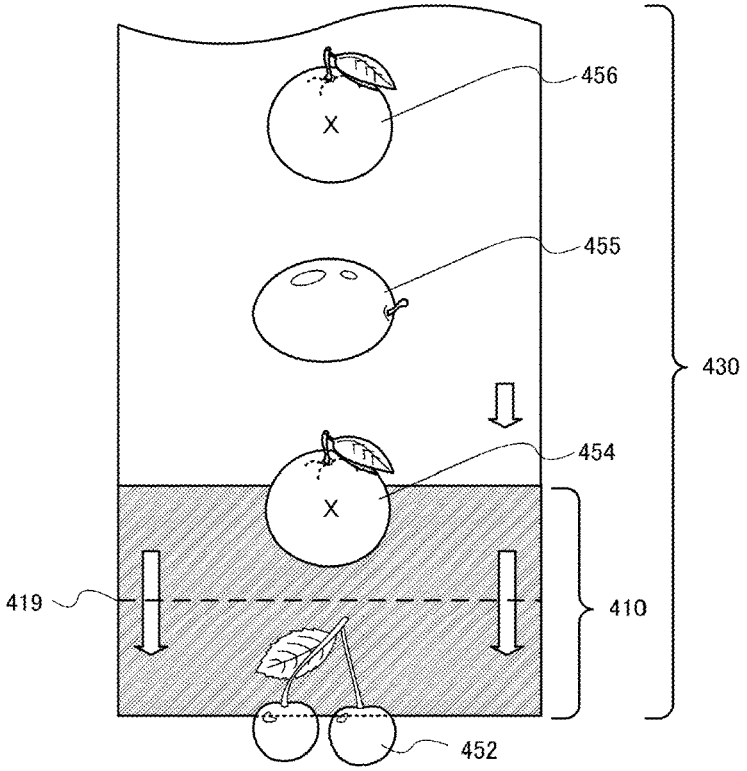
FIGS. 22A and 22B are views showing a pattern of a symbol stop effect in an effect reel of a gaming machine.
Figure 22B:
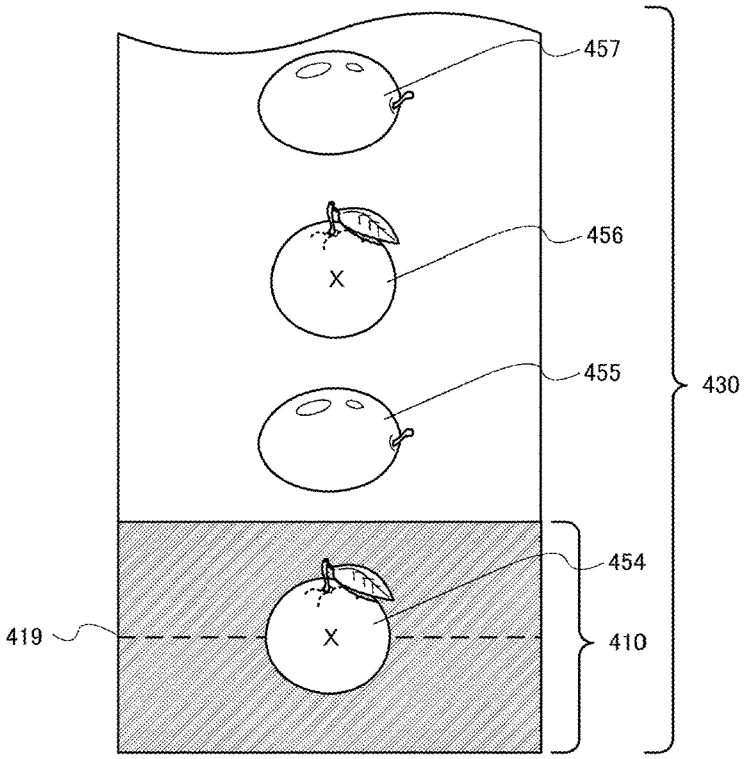

In addition, the processing operation of replacing the COIN symbol 453 with the ORANGE symbol 454, shown in FIG. 21A and FIG. 21B, is merely illustrated for the sake of showing its related conceptual idea. As illustrated, although it is also possible to replace an image storage region of the COIN symbol 453 in a video RAM with an image of the ORANGE symbol 454, for example, a processing operation similar thereto can be achieved by another processing operation of replacing or exchanging a pointer indicative of a start position in the image storage region of the COIN symbol 453 with a pointer that is indicative of a start position of an image storage region of the ORANGE symbol 454 as well.

It is to be noted that in an example of FIG. 21A, a symbol which is not displayed in the effect reel display region 410, and which is to be subsequently displayed, is set to the COIN symbol 453, and thus, there takes place a need to replace the current symbol with the ORANGE symbol 454 that is a predetermined symbol; and however, in the case where an ORANGE symbol is rearranged at the position at which the COIN symbol 453 is set, there is no need to conduct the switching processing of symbol images as described above.

As described above, in the gaming machine according to the present invention, with respect to the symbols on a respective one of the video reels 3*a* to 3*e* determined by the symbol determination processing portion 303, a winning combination is determined by the prize determination processing portion 304, and according to the winning combination, the effect control processing portion 307 determines whether or not to display an effect reel in the effect reel display region 410. When a player executes a touch operation or the like on a touch panel, a display mode of a predetermined symbol, at that juncture, is changed according to whether or not the predetermined symbol is displayed in the effect reel display region 410. That is, in the case where the predetermine symbol is displayed, if the predetermined symbol is upper than a to-be-display position, the symbol is slid in a downward direction and then the slid symbol is stopped at the to-be-display position, or alternatively, if the symbol is lower than the to-be-displayed position, the symbol is slid in a upward direction and then the slid symbol is stopped at the to-be-displayed position.

However, in the display control processing as described above, even if there takes place a situation in which the predetermined symbol is not displayed in the effect reel display region 410 at a time point of a player's operation, scrolling and stoppage of the effect reel can be displayed in a natural scroll manner. For example, in the case where a touch operation of a player is made immediately before a predetermined symbol appears in the effect reel display region 410 (with a timing with which the predetermined symbol is displayed in the effect reel display region 410 with a slight difference), as is the case in which the predetermined symbol is displayed, control may be effected so as to cause the predetermined symbol to appear as it is from an upper part of the effect reel display region 410, move in the downward direction, and then, stop at the to-be-stopped position. Similarly, in the case where a player's touch operation is made immediately after a predetermined symbol has moved in the effect reel display region 410 in a downward direction and then the predetermined symbol cannot be visually recognized (after an only slight period of time has elapsed), as is the case in which the predetermined symbol is displayed, control may be effected so as to cause the predetermined symbol to appear from a lower part of the effect reel display region 410, move in an upward direction, and then, stop at the to-be-stopped position.

In addition, in the display control processing described above, in the case where a predetermined symbol is not displayed in the effect reel display region 410, a symbol to be displayed in the effect reel display region 410 is switched to the predetermined symbol immediately thereafter, the predetermined symbol is caused to appear from the upper part of the effect reel display region 410, move in the downward direction, and then, stop at the to-be-stopped position; and however, scrolling can also be controlled so as to display the predetermined symbol in a state in which two or more slidable frames are set. For example, in the case where the predetermined symbol is not displayed in the effect reel display region 410, scrolling can be controlled so that a further subsequent symbol to the symbol to be displayed in the effect reel display region 410 immediately thereafter is switched to the predetermined symbol.

Figure 23:
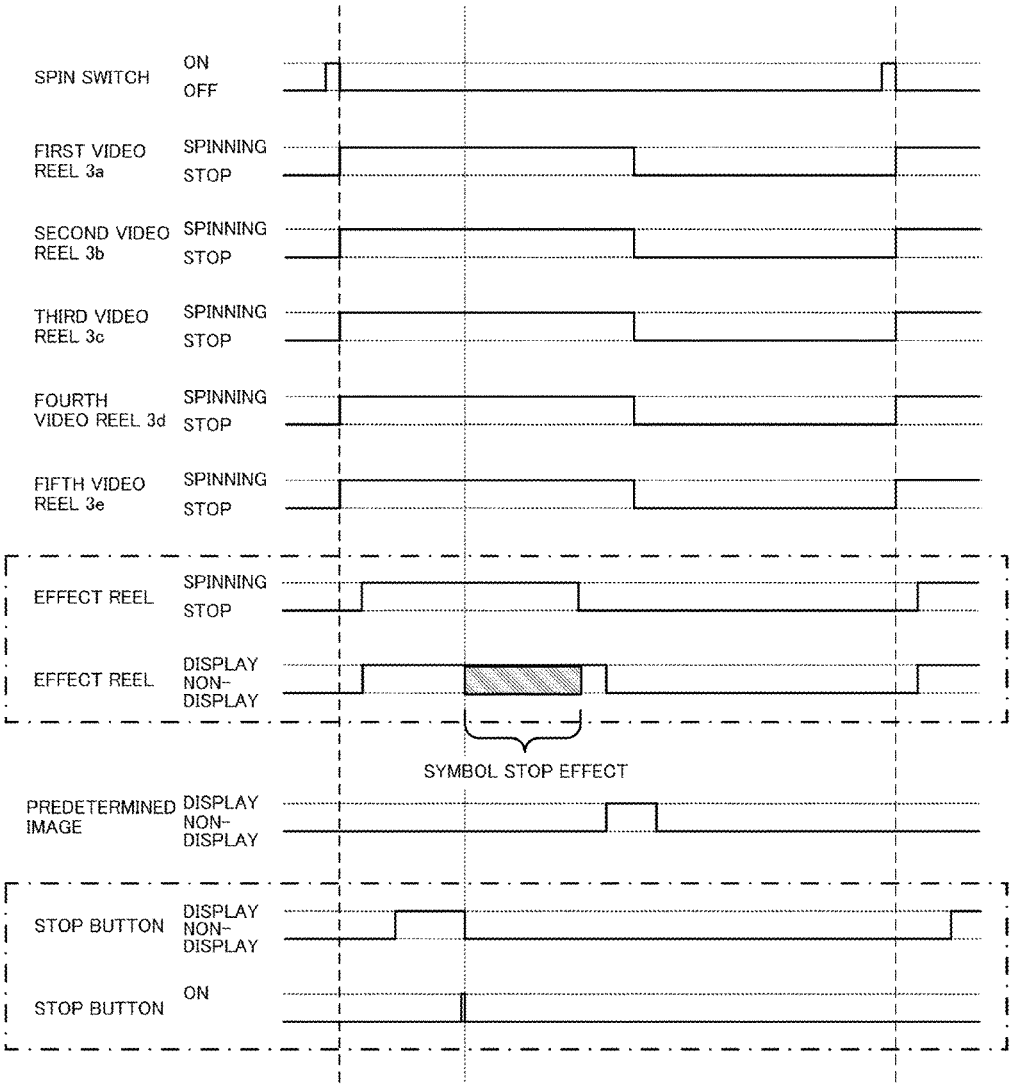
FIG. 23 is a timing chart showing a timing of symbol display control processing in the gaming machine.

Next, with reference to the timing chart of FIG. 23, a timing of symbol display control processing including symbol stop effect processing will be described. First, when a spin button is pressed by a player, a spin switch turns ON and then scrolling (variable displaying) of the symbols on the first to fifth video reels 3*a* to 3*e* is started (step S131 of FIG. 14). Although, in this example, the first to fifth video reels 3*a* to 3*e* start scrolling at the same time by depressing a spin button, the start of scrolling may be conducted in a state in which a difference in time intervals is provided.

Then, after a predetermined period of time has elapsed, an effect reel is displayed in the effect reel display region 410, and at the same time, scrolling of the symbol arrays on the effect reel is started (step S136 of FIG. 14). It is to be noted that, although in this example, scrolling of the symbol arrays is started at the same time when the effect reel is displayed, such scrolling may be started after a predetermined period of time has elapsed after the effect reel has been displayed. Next, a stop button is displayed in the effect reel display region 410 (step S137 of FIG. 14). It is to be noted that scrolling can also be controlled so as to display the stop button at an almost same time when the effect reel is displayed. The size of the stop button changes according to the number of payouts for a winning combination, as described above.

After the stop button has been displayed, when a player depresses the stop button by a touch operation, accompanying with this depressing, symbol stop effect processing is conducted on the effect reel (step S141 of FIG. 14). For example, effect processing is conducted in such a manner that a predetermined symbol which is a symbol that is associated with a winning combination stops at a to-be-stopped position, the predetermined symbol stops, and scrolling of the effect reel also stops. Then, after a predetermined period of time has elapsed, the display of the effect reel disappears from the effect reel display region 410, and in place of the display having disappeared, a predetermined image is displayed in the symbol display region 4 (step S142 of FIG. 14).

After a predetermined period of time has elapsed after the predetermined image has been displayed in the symbol display region 4, the predetermined image is cleared (step S144 of FIG. 14), and symbol arrays of which scrolling has been stopped is displayed in the symbol display region 4. FIG. 23 shows that scrolling of the symbol arrays on the first to fifth video reels 3*a* to 3*e* is stopped while the predetermined image is displayed for the sake of convenience; and however, as described above, in actual processing, it is sufficient if an image that is indicative of a stopped state of the symbol arrays on the video reels 3 be prepared in a video RAM or the like until the predetermined image has been cleared.

In addition, scrolling of the video reels 3 can also be displayed so as to be stopped or be slowdown in speed until all over the symbol display region 4 has been covered by displaying the predetermined image after scrolling of the effect reel has been stopped by symbol stop effect processing. At this time, the effect reel is still left to be displayed; and therefore, with respect to the symbols that are displayed in a stopped state on the first to fifth video reels 3*a* to 3*e*, a part of the outside of the effect reel display region 410 can only be seen, and a player cannot determine whether or not a winning combination is established. In the case where the effect reel is stopped, scrolling of the first to fifth video reels 3*a* to 3*e* may be stopped in a state in which a difference in time intervals is provided.

<Number-of-Payouts Determination Processing>

Figure 16:
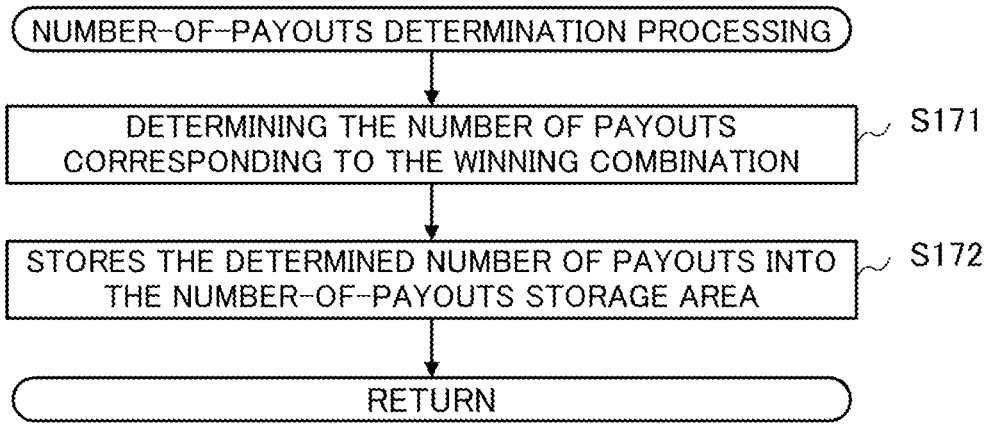
FIG. 16 is a view illustrating a flowchart of number-of-payouts determination processing for the gaming machine.

Next, with reference to FIG. 16, the number-of-payouts determination processing is described. FIG. 16 is a view illustrating a flowchart of the number-of-payouts determination processing for the gaming machine 1 according to the embodiment of the present invention.

The main CPU 71, first determines the number of payouts corresponding to the winning combination (step S171). For example, with reference to the symbol combination table, when the winning combination is "ORANGE 3", a numeral "20" is determined as the number of payouts (see FIG. 8). It is to be noted that the main CPU 71 determines "0" as the number of payouts in the case where the game is lost. Next, the main CPU 71 stores the determined number of payouts into the number-of-payouts storage area (step S173). After the processing has been conducted, the number-of-payouts determination processing is completed.

What is claimed is:

1. A gaming machine comprising:

a game medium acceptor that accepts a physical game medium with a first monetary value;

a bet input device that receives a bet from the player based on the credit balance;

a display having a first display region configured to variably display first symbols including a plurality of kinds of symbols and then display the first symbols in a stopped state and a second display region configured to variably display second symbols that are associated with at least one kind of the first symbols and then display the second symbols in a stopped state;

an input device that is operated by a player and includes a touch sensor configured to detect a touch operation exerted by the player; and a controller which accepts the game medium via the game medium acceptor, establishes a credit balance for a player based at least in part on the game medium, receives via the bet input device a bet from the player based on the credit balance, and which is programmed to, as a result of the player's bet, execute processing operations of (1-1) to (1-7) below:

(1-1) determining the first symbols to be displayed in a stopped state, by a lottery;

(1-2) determining whether or not the first symbols to be displayed in a stopped state form a specific combination;

(1-3) determining the second symbols that are associated with at least one kind of the first symbols to be displayed in the stopped state, in a case where it is determined that the first symbols to be displayed in the stopped state form a specific combination;

(1-4) variably displaying the second symbols in the second display region before the first symbols are displayed in a stopped state in the first display region;

(1-4-1) displaying a button for the touch operation in the second display region while variably displaying the second symbols in the second display region, wherein a size of the button changes according to a combination of the first symbols to be displayed in the stopped state;

(1-5) displaying the second symbols in a stopped state in the second display region when the touch sensor detects the touch operation on the button exerted by the player, wherein in a case where a predetermined symbol of the second symbols is not displayed in the second display region at a timing when the touch operation is exerted by the player, a symbol displayed in the second display region at said timing are replaced with the predetermined symbol outside the second display region;

(1-6) displaying the first symbols in a stopped state in the first display region after the second symbols have been displayed in a stopped state in the second display region; and (1-7) paying out a physical game medium with a secondary monetary value or establishing the credit balance according to a payout determined by the combination of the first symbols.

2. The gaming machine according to claim 1, wherein the processing operation of (1-5) includes a processing operation of (1-5-1) switching a display mode when the second symbols are displayed in a stopped state in the second display region, according to a display state of the second symbols in the second display region when the input device is operated.

3. The gaming machine according to claim 2, wherein the processing operation of (1-5-1) includes a processing operation of (1-5-1-1) displaying the second symbols in a stopped state after the second symbols each have been moved to a to-be-stopped position in a case where the second symbols are displayed in the second display region when the input device is operated.

4. The gaming machine according to claim 2, wherein the processing operation of (1-5-1) includes a processing operation of (1-5-1-2), when the input device is operated, in a case where the second symbols are not displayed in the second display region, controlling symbols that appear from an upper part of the second display region immediately after the input device has been operated, so as to be obtained as the second symbols, and then, moving the second symbols so as to be displayed in a stopped state at a to-be-stopped position.

5. The gaming machine according to claim 1, wherein the first display region and the second display region have an overlap portion in at least a part of the first and second display regions, and the second symbols are displayed so as to overlap on the first symbols.

6. The gaming machine according to claim 1, wherein the button is displayed on the second symbols which are variably displayed.

7. The gaming machine according to claim 1, wherein the size of the button displayed when a number of payouts to be awarded according to the combination is a first number is greater than the size of the button displayed when the number of payouts to be awarded according to the combination is a second number being smaller than the first number.

8. A gaming machine comprising:

a game medium acceptor that accepts a physical game medium with a first monetary value;

a bet input device that receives a bet from the player based on the credit balance;

an input device that is operated by a player;

a display including a symbol display region that variably display symbols and then stops the second symbols when the input device is operated by the player; and a controller which accepts the (lame medium via the (lame medium acceptor, establishes a credit balance for a player based at least in part on the game medium, receives via the bet input device a bet from the player based on the credit balance, and is programmed to, as a result of the player's bet, in a case where the input device is operated by the player at a timing when a predetermined symbol is not displayed in the symbol display region, replace a symbol in the symbol display region with the predetermine symbol outside the symbol display region while the symbols are variably displayed, thereby allowing the predetermined symbol to be stopped in the symbol display region.

* * * * *